US007033260B2

(12) United States Patent
Togawa et al.

(10) Patent No.: US 7,033,260 B2
(45) Date of Patent: Apr. 25, 2006

(54) SUBSTRATE HOLDING DEVICE AND POLISHING DEVICE

(75) Inventors: Tetsuji Togawa, Tokyo (JP); Osamu Nabeya, Tokyo (JP); Makoto Fukushima, Tokyo (JP); Kunihiko Sakurai, Tokyo (JP); Hiroshi Yoshida, Toyko (JP); Teruhiko Ichimura, Tokyo (JP)

(73) Assignee: Ebara Corporation, Tokyo (JP)

( * ) Notice: Subject to any disclaimer, the term of this patent is extended or adjusted under 35 U.S.C. 154(b) by 0 days.

(21) Appl. No.: 10/497,151

(22) PCT Filed: Dec. 6, 2002

(86) PCT No.: PCT/JP02/12816

§ 371 (c)(1),
(2), (4) Date: Dec. 29, 2004

(87) PCT Pub. No.: WO03/049168

PCT Pub. Date: Jun. 12, 2003

(65) Prior Publication Data

US 2005/0107015 A1 May 19, 2005

(30) Foreign Application Priority Data

Dec. 6, 2001 (JP) ..... 2001-372771
Dec. 12, 2001 (JP) ..... 2002-379337

(51) Int. Cl.
*B24B 1/00* (2006.01)

(52) U.S. Cl. ..... 451/388; 451/389

(58) Field of Classification Search ..... 451/41, 451/285, 288, 289, 388, 390, 398, 460
See application file for complete search history.

(56) References Cited

U.S. PATENT DOCUMENTS

| | | | | |
|---|---|---|---|---|
| 6,210,255 | B1 * | 4/2001 | Zuniga et al. | 451/41 |
| 6,390,904 | B1 * | 5/2002 | Gleason et al. | 451/286 |
| 6,422,927 | B1 * | 7/2002 | Zuniga | 451/288 |
| 2002/0098780 | A1 | 7/2002 | Boo et al | |

FOREIGN PATENT DOCUMENTS

| | | |
|---|---|---|
| EP | 1066925 A2 | 1/2001 |
| JP | 8-229804 | 9/1996 |
| JP | 2000/301453 | 10/2000 |
| JP | 2001-60572 | 3/2001 |
| JP | 2001-260004 | 9/2001 |
| JP | 2002-187060 | 7/2002 |
| JP | 2002-198337 | 7/2002 |

* cited by examiner

*Primary Examiner*—Jacob K. Ackun, Jr.
(74) *Attorney, Agent, or Firm*—Wenderoth, Lind & Ponack, L.L.P.

(57) ABSTRACT

The present invention relates to a substrate holding apparatus for holding a substrate such as a semiconductor wafer in a polishing apparatus for polishing the substrate to a flat finish. The substrate holding apparatus according to the present invention comprises a top ring body having a receiving space therein, and a vertically movable member which is vertically movable within the receiving space in the top ring body. An abutment member having an elastic membrane is attached to a lower surface of the vertically movable member. The elastic membrane of the abutment member comprises an abutment portion, having a flange projecting outwardly, brought into direct or indirect contact with the substrate, and a connecting portion extending upwardly from a base portion of the flange of the abutment portion and being connected to the vertically movable member. The connecting portion is made of a material having a flexibility higher than that of material of the abutment portion.

42 Claims, 16 Drawing Sheets

SUBSTRATE HOLDING DEVICE AND POLISHING DEVICE

This application is a National Stage application of PCT/JP02/12816, filed Dec. 6, 2002.

TECHNICAL FIELD

The present invention relates to a substrate holding apparatus for holding a substrate to be polished and pressing the substrate against a polishing surface, and more particularly to a substrate holding apparatus for holding a substrate such as a semiconductor wafer in a polishing apparatus for polishing the substrate to a flat finish. The present invention also relates to a polishing apparatus having such a substrate holding apparatus.

BACKGROUND ART

In recent years, semiconductor devices have become more integrated, and structures of semiconductor elements have become more complicated. Further, a number of layers in multilayer interconnections used for a logical system has been increased. Accordingly, irregularities on a surface of a semiconductor device become increased, so that step heights on the surface of the semiconductor device tend to be larger. This is because, in a manufacturing process of a semiconductor device, a thin film is formed on a semiconductor device, then micromachining processes, such as patterning or forming holes, are performed on the semiconductor device, and these processes are repeated many times to form subsequent thin films on the semiconductor device.

When a number of irregularities is increased on a surface of a semiconductor device, the following problems arise. A thickness of a film formed in a portion having a step is relatively small when a thin film is formed on a semiconductor device. An open circuit is caused by disconnection of interconnections, or a short circuit is caused by insufficient insulation between interconnection layers. As a result, good products cannot be obtained, and yield tends to be reduced. Further, even if a semiconductor device initially works normally, reliability of the semiconductor device is lowered after long-term use. At a time of exposure during a lithography process, if an irradiation surface has irregularities, then a lens unit in an exposure system is locally unfocused. Therefore, if the irregularities of the surface of the semiconductor device are increased, then this becomes problematic in that it is difficult to form a fine pattern itself on the semiconductor device.

Accordingly, in a manufacturing process of a semiconductor device, it increasingly becomes important to planarize a surface of the semiconductor device. The most important one of planarizing technologies is CMP (Chemical Mechanical Polishing). In such chemical mechanical polishing, with use of a polishing apparatus, while a polishing liquid containing abrasive particles such as silica ($SiO_2$) therein is supplied onto a polishing surface such as a polishing pad, a substrate such as a semiconductor wafer is brought into sliding contact with the polishing surface, so that the substrate is polished.

This type of polishing apparatus comprises a polishing table having a polishing surface constituted by a polishing pad, and a substrate holding apparatus, which is called as a top ring or a carrier head, for holding a semiconductor wafer. When a semiconductor wafer is polished with such a polishing apparatus, the semiconductor wafer is held and pressed against the polishing table under a predetermined pressure by the substrate holding apparatus. At this time, the polishing table and the substrate holding apparatus are moved relatively to each other to bring the semiconductor wafer into sliding contact with the polishing surface, so that a surface of the semiconductor wafer is polished to a flat mirror finish.

In such a polishing apparatus, if a relative pressing force between the semiconductor wafer being polished and the polishing surface of the polishing pad is not uniform over an entire surface of the semiconductor wafer, then the semiconductor wafer may insufficiently be polished or may excessively be polished at some portions depending on a pressing force applied to those portions of the semiconductor wafer. Therefore, it has been attempted to form a surface, for holding a semiconductor wafer, of a substrate holding apparatus by an elastic membrane made of an elastic material such as rubber and to supply fluid pressure such as air pressure to a backside surface of the elastic membrane to uniformize pressing forces applied to the semiconductor wafer over an entire surface of the semiconductor wafer.

Further, the polishing pad is so elastic that pressing forces applied to a peripheral portion of the semiconductor wafer being polished become non-uniform, and hence only the peripheral portion of the semiconductor wafer may excessively be polished, which is referred to as "edge rounding". In order to prevent such edge rounding, there has been used a substrate holding apparatus in which a semiconductor wafer is held at its peripheral portion by a guide ring or a retainer ring, and an annular portion of the polishing surface that corresponds to the peripheral portion of the semiconductor wafer is pressed by the guide ring or retainer ring.

A thickness of a thin film formed on a surface of a semiconductor wafer varies from position to position in a radial direction of the semiconductor wafer depending on a film deposition method or characteristics of a film deposition apparatus. Specifically, the thin film has a film thickness distribution in the radial direction of the semiconductor wafer. Since a conventional substrate holding apparatus, as described above, for uniformly pressing an entire surface of a semiconductor wafer polishes the semiconductor wafer uniformly over the entire surface thereof, it cannot realize a polishing amount distribution that is equal to the aforementioned film thickness distribution on the surface of the semiconductor wafer. Therefore, the conventional polishing apparatus cannot sufficiently cope with the film thickness distribution in the radial direction, and insufficient or excessive polishing is caused.

Further, the aforementioned film thickness distribution on the surface of the semiconductor wafer varies depending on a type of a film deposition method or a film deposition apparatus. Specifically, positions and a number of portions having a large film thickness in a radial direction and differences in thickness between thin film portions and thick film portions vary depending on the type of a film deposition method or the film deposition apparatus. Therefore, a substrate holding apparatus capable of easily coping with various film thickness distributions at low cost has been required rather than a substrate holding apparatus capable of coping with only a specific film thickness distribution.

In a substrate holding apparatus having a structure for pressing a portion of a polishing surface that corresponds to a peripheral portion of a semiconductor wafer by a guide ring or retainer ring in order to prevent edge rounding, non-uniform polishing such as edge rounding cannot sufficiently be suppressed in some cases by merely controlling pressing forces of the aforementioned guide ring or retainer ring. Generally, no devices are formed on a peripheral portion of a semiconductor wafer. Nevertheless, for a purpose of preventing elution of metal or other defects, it is required that a polishing rate is intentionally reduced at a peripheral portion of a semiconductor wafer so that an underlayer film is not exposed, or, on the contrary, a polishing rate is intentionally increased at a peripheral potion of a semiconductor wafer so as to remove a film on the peripheral potion of the semiconductor wafer. A conventional polishing apparatus cannot sufficiently control a polishing rate at a peripheral potion of a semiconductor wafer to a desired level.

SUMMARY OF THE INVENTION

The present invention has been made in view of the above prior art. It is, therefore, a first object of the present invention to provide a substrate holding apparatus and a polishing apparatus which can polish a thin film, formed on a surface of a workpiece such as a semiconductor wafer, having a film thickness distribution, and can obtain a uniform film thickness after polishing.

Further, the present invention has been made in view of the above prior art in which a polishing rate at a peripheral portion of a workpiece cannot sufficiently be controlled to a desired level. It is, therefore, a second object of the present invention to provide a substrate holding apparatus and a polishing apparatus which can uniformly polish a workpiece such as a semiconductor wafer while controlling a polishing rate at a peripheral portion of the workpiece to a desired level.

In order to attain the first object, according to a first aspect of the present invention, there is provided a substrate holding apparatus for holding and pressing a substrate to be polished against a polishing surface, characterized in that: the substrate holding apparatus comprises a top ring body having a receiving space therein, and a vertically movable member which is vertically movable within the receiving space in the top ring body; an abutment member having an elastic membrane is attached to a lower surface of the vertically movable member; the elastic membrane of the abutment member comprises an abutment portion, having flanges projecting outwardly and inwardly, brought into direct or indirect contact with the substrate, and connecting portion extending upwardly from base portions of the flanges of the abutment portion and being connected to the vertically movable member; and the connecting portions are made of a material having a flexibility higher than that of material of the abutment portion.

With this arrangement, pressures to be applied to the substrate can independently be controlled, and hence a pressing force applied to a thicker area of a thin film can be made higher than a pressing force applied to a thinner area of the thin film, thereby selectively increasing a polishing rate of the thicker area of the thin film. Thus, an entire surface of a substrate can be polished exactly to a desired level irrespective of a film thickness distribution obtained at a time the thin film is formed. Further, even if the vertically movable member is pressed downwardly for polishing, excessive downward forces are not applied to the substrate which is brought into close contact with the abutment portion because the connecting portion is elastically deformed, so that a uniform polishing rate can be achieved in an area between the base portions of the flanges. Further, even if the vertically movable member is lifted for polishing, excessive upward forces are not applied to the abutment portion because the connecting portion is likely to extend, so that a vacuum is not formed near the base portions of the flanges to achieve a uniform polishing rate in an area between the base portions.

According to a second aspect of the present invention, there is provided a substrate holding apparatus for holding and pressing a substrate to be polished against a polishing surface, characterized in that: the substrate holding apparatus comprises a top ring body having a receiving space therein, and a vertically movable member which is vertically movable within the receiving space in the top ring body; an abutment member having an elastic membrane is attached to a lower surface of the vertically movable member; the elastic membrane of the abutment member comprises an abutment portion, having flanges projecting outwardly and inwardly, brought into direct or indirect contact with the substrate, and connecting portions extending upwardly from base portions of the flanges of the abutment portion and being connected to the vertically movable member; and the connecting portions comprise a thin portion having a thickness smaller than that of the abutment portion.

With this arrangement, an entire surface of a substrate can be polished exactly to a desired level irrespective of a film thickness distribution obtained at a time the thin film is formed. Simultaneously, even if the vertically movable member is pressed downwardly for polishing, excessive downward forces are not applied to the substrate which is brought into close contact with the abutment portion because the connecting portion is likely to be deformed at the thin portion, so that a uniform polishing rate can be achieved in an area between the base portions of the flanges. Further, even if the vertically movable member is lifted for polishing, excessive upward forces are not applied to the abutment portion because the thin portions are likely to extend, so that a vacuum is not formed near the base portions of the flanges to achieve a uniform polishing rate in an area between the base portions. Particularly, when the thin portions are formed so as to be constricted inwardly in cross-section, these effects can effectively be achieved.

According to a third aspect of the present invention, there is provided a substrate holding apparatus for holding and pressing a substrate to be polished against a polishing surface, characterized in that: the substrate holding apparatus comprises a top ring body having a receiving space therein, and a vertically movable member which is vertically movable within the receiving space in the top ring body; an abutment member having an elastic membrane is attached to a lower surface of the vertically movable member; the elastic membrane of the abutment member comprises an abutment portion, having flanges projecting outwardly and inwardly, brought into direct or indirect contact with the substrate, and connecting portions extending upwardly from base portions of the flanges of the abutment portion and being connected to the vertically movable member; and adhesiveness of a lower surface of the base portions of the flanges of the abutment portion is weakened.

With this arrangement, an entire surface of a substrate can be polished exactly to a desired level irrespective of a film thickness distribution obtained at a time a thin film is formed. Simultaneously, even if the vertically movable member is lifted for polishing, a vacuum is unlikely to be formed near the base portions of the flanges because the base portions of the flanges is unlikely to be brought into close contact with the substrate. Therefore, a uniform polishing rate can be achieved in an area between base portions.

In this case, an intermediate member having a low adhesiveness to the substrate may be disposed on a lower surface of the base portions of the flanges of the abutment portion to weaken adhesiveness of the lower surface of the base portions of the flanges. Alternatively, adhesiveness between the base portions of the flanges and the substrate may be weakened by, for example, forming a groove in the lower surface of the base portions of the flanges, or by forming the lower surface of the base portions as a rough surface.

According to a fourth aspect of the present invention, there is provided a substrate holding apparatus for holding and pressing a substrate to be polished against a polishing surface, characterized in that: the substrate holding apparatus comprises a top ring body having a receiving space therein, and a vertically movable member which is vertically movable within the receiving space in the top ring body; an abutment member having an elastic membrane is attached to a lower surface of the vertically movable member; the elastic membrane of the abutment member comprises an abutment portion, having flanges projecting outwardly and inwardly, brought into direct or indirect contact with the substrate, and connecting portions extending upwardly from base portions of the flanges of the abutment portion and being connected to the vertically movable member; and a hard member made of a material harder than that of the elastic membrane is embedded in the base portions of the flanges of the abutment portion. In this case, the hard member should preferably have an annular shape.

With this arrangement, an entire surface of a substrate can be polished exactly to a desired level irrespective of a film thickness distribution obtained at a time the thin film is formed. Simultaneously, even if the vertically movable member is downwardly pressed for polishing, excessive downward forces are not applied to the substrate which is brought into close contact with the abutment portion because downward forces by the connecting portions are dispersed by the hard members, so that a uniform polishing rate can be achieved in an area between base portions of the flanges. Further, even if the vertically movable member is lifted for polishing, a vacuum is not formed near the base portions of the flanges because the hard member prevents deformation of the vicinity of the base portions of the flanges. Therefore, a uniform polishing rate can be achieved in an area between the base portions of the flanges.

According to a fifth aspect of the present invention, there is provided a substrate holding apparatus for holding and pressing a substrate to be polished against a polishing surface, characterized in that: the substrate holding apparatus comprises a top ring body having a receiving space therein, and a vertically movable member which is vertically movable within the receiving space in the top ring body; an abutment member having an elastic membrane is attached to a lower surface of the vertically movable member; and the elastic membrane of the abutment member comprises an abutment portion, having flanges projecting outwardly and inwardly, brought into direct or indirect contact with the substrate, an extending portion extending outwardly from a base portion of each flange to a position inward of a tip of this flange to form a groove between the extending portion and the flange of the abutment portion, and a connecting portion extending upwardly from an outward end of the extending portion and being connected to the vertically movable member.

With this arrangement, an entire surface of a substrate can be polished exactly to a desired level irrespective of a film thickness distribution obtained at a time a thin film is formed. Further, in a case where the vertically movable member is lifted for polishing after the substrate is brought into close contact with the abutment portion, upward forces by the connecting portion are converted into forces in horizontal or oblique directions by the extending portion, and these converted forces are applied to the base portions of the flanges. Therefore, upward forces applied to the base portions of the flanges can be made extremely small, so that excessive upward forces are not applied to the abutment portion. Accordingly, a vacuum is not formed near the base portions, so that a uniform polishing rate can be achieved in an area between the base portions.

According to a preferred aspect of the present invention, the connecting portion positioned radially inwardly and the connecting portion positioned radially outwardly have different thicknesses. In this case, it is desirable that the connecting portion positioned radially inwardly has a thickness smaller than a thickness of the connecting portion positioned radially outwardly.

According to a preferred aspect of the present invention, the flange projecting radially outwardly and the flange projecting radially inwardly have different lengths. In this case, it is desirable that the flange projecting radially outwardly has a length larger than that of the flange projecting radially inwardly.

Because a cylinder having a smaller curvature generally has a stiffness larger than a cylinder having a larger curvature, a vertical force applied to the base portion of the flange by the connecting portion positioned radially inwardly becomes larger than a force applied to the base portion of the flange by the connecting portion positioned radially outwardly. Therefore, with the above arrangement, forces applied to the base portions of the flange positioned radially inwardly and the flange positioned radially outwardly can be adjusted to the same level, or a sealing capability can be enhanced at the flange projecting radially outwardly, so that a uniform polishing rate can be achieved in an area between the base portions.

According to a sixth aspect of the present invention, there is provided a substrate holding apparatus for holding and pressing a substrate to be polished against a polishing surface, characterized in that: the substrate holding apparatus comprises a top ring body having a receiving space therein, and a vertically movable member which is vertically movable within the receiving space in the top ring body; an abutment member having an elastic membrane which is brought into direct or indirect contact with the substrate is attached to a lower surface of the vertically movable member; and the vertically movable member is made of a material having a large stiffness.

With this arrangement, when the vertically movable member is made of a material having a large stiffness and a light weight, e.g., epoxy resin, the vertically movable member becomes unlikely to be bent, so that polishing rates are prevented from being locally increased. Further, when a material having no magnetism is selected as a material of the vertically movable member, a film thickness of a thin film formed on a surface of a semiconductor wafer to be polished can be measured with a film thickness method using eddy current in such a state that the semiconductor wafer is held.

According to a seventh aspect of the present invention, there is provided a substrate holding apparatus for holding and pressing a substrate to be polished against a polishing surface, characterized in that: an abutment member having an elastic membrane is attached to a lower surface of a top ring; the elastic membrane of the abutment member comprises an abutment portion, having a flange projecting outwardly, brought into direct or indirect contact with the substrate, and a connecting portion extending upwardly from a base portion of the flange of the abutment portion and being connected to the top ring; and the top ring has a support portion for supporting the flange of the abutment member.

With this arrangement, an entire surface of a substrate can be polished exactly to a desired level irrespective of a film thickness distribution obtained at a time a thin film is formed. Simultaneously, when a pressurized fluid is supplied into a space around the abutment member, the flange is prevented from being deformed and attached to a lower surface of the top ring, thereby achieving stable polishing.

In this case, it is desirable that the support portion has a radial length larger than a radial length of the flange of the abutment member. With such a support portion, the flange of the abutment member can be supported more reliably, so that more stable polishing can be achieved.

According to a preferred aspect of the present invention, a fluid introduction groove for introducing a fluid into an upper surface of the flange of the abutment member is formed in the support portion. With this arrangement, since a pressurized fluid can be introduced into the upper surface of the flange, adhesiveness of the flange to the substrate can be enhanced to achieve stable polishing.

According to an eighth aspect of the present invention, there is provided a substrate holding apparatus for holding and pressing a substrate to be polished against a polishing surface, characterized in that: the substrate holding apparatus comprises a top ring body having a receiving space therein, a vertically movable member which is vertically movable within the receiving space in the top ring body, and a seal ring being brought into contact with an upper surface of a peripheral portion of the substrate; and the vertically movable member has a support portion for supporting the seal ring, with the support portion having a radial length in a range of from 1 mm to 7 mm.

With this arrangement, an entire surface of a substrate can be polished exactly to a desired level irrespective of a film thickness distribution obtained at a time a thin film is formed. Simultaneously, when a pressurized fluid is supplied into a space around the seal ring, the seal ring is prevented from being deformed and attached to a lower surface of the vertically movable member. Further, a peripheral portion of the substrate is likely to be excessively polished. However, when the support portion has a radial length in a range of from 1 mm to 7 mm, it is possible to prevent excessive polishing.

According to a preferred aspect of the present invention, a fluid introduction groove for introducing a fluid into an upper surface of the seal ring is formed in the support portion of the vertically movable member. With this arrangement, since a pressurized fluid can be introduced into the upper surface of the seal ring, adhesiveness of the seal ring to the substrate can be enhanced to achieve stable polishing.

In order to attain the second object, according to a ninth aspect of the present invention, there is provided a substrate holding apparatus for holding and pressing a substrate to be polished against a polishing surface, characterized in that: the substrate holding apparatus comprises a top ring body for holding the substrate, with an edge bag being brought into contact with a peripheral portion of the substrate, and a torque transmitting member being brought into contact with the substrate radially inwardly of the edge bag; and a pressure of a first pressure chamber defined in the edge bag and a pressure of a second pressure chamber defined radially inwardly of the edge bag are independently controlled.

With this arrangement, sufficient torque can be transmitted to the substrate by the torque transmitting member. Further, an entire surface of the substrate except the peripheral portion thereof can be pressed against the polishing surface at a uniform force by pressure of the second pressure chamber, and pressure of the first pressure chamber can be controlled independently of the pressure of the second pressure chamber. Therefore, it is possible to control a polishing rate at the peripheral portion of the substrate, i.e., a polishing profile of the peripheral portion of the substrate.

According to a preferred aspect of the present invention, the torque transmitting member has a communication hole communicating a space inside of the torque transmitting member and a space outside of the torque transmitting member with each other.

Further, in view of controlling a polishing rate of a peripheral portion of the semiconductor wafer, it is desirable that the edge bag defining the first pressure chamber comprises a member having a radial width in a range of from 1 mm to 10 mm.

According to a preferred aspect of the present invention, the substrate holding apparatus comprises a retainer ring secured to or formed integrally with the top ring body for holding a side edge portion of the substrate; and a pressing force to press the retainer ring against the polishing surface is controlled independently of a pressure of the pressure chamber. In this manner, when the pressing force of the retainer ring is also controlled, more detailed control can be achieved.

A polishing apparatus according to the present invention comprises the aforementioned substrate holding apparatus and a polishing table having a polishing surface.

DETAILED DESCRIPTION OF THE PREFERRRED EMBODIMENTS

A substrate holding apparatus and a polishing apparatus according to embodiments of the present invention will be described in detail below with reference to the drawings.

Figure 1:
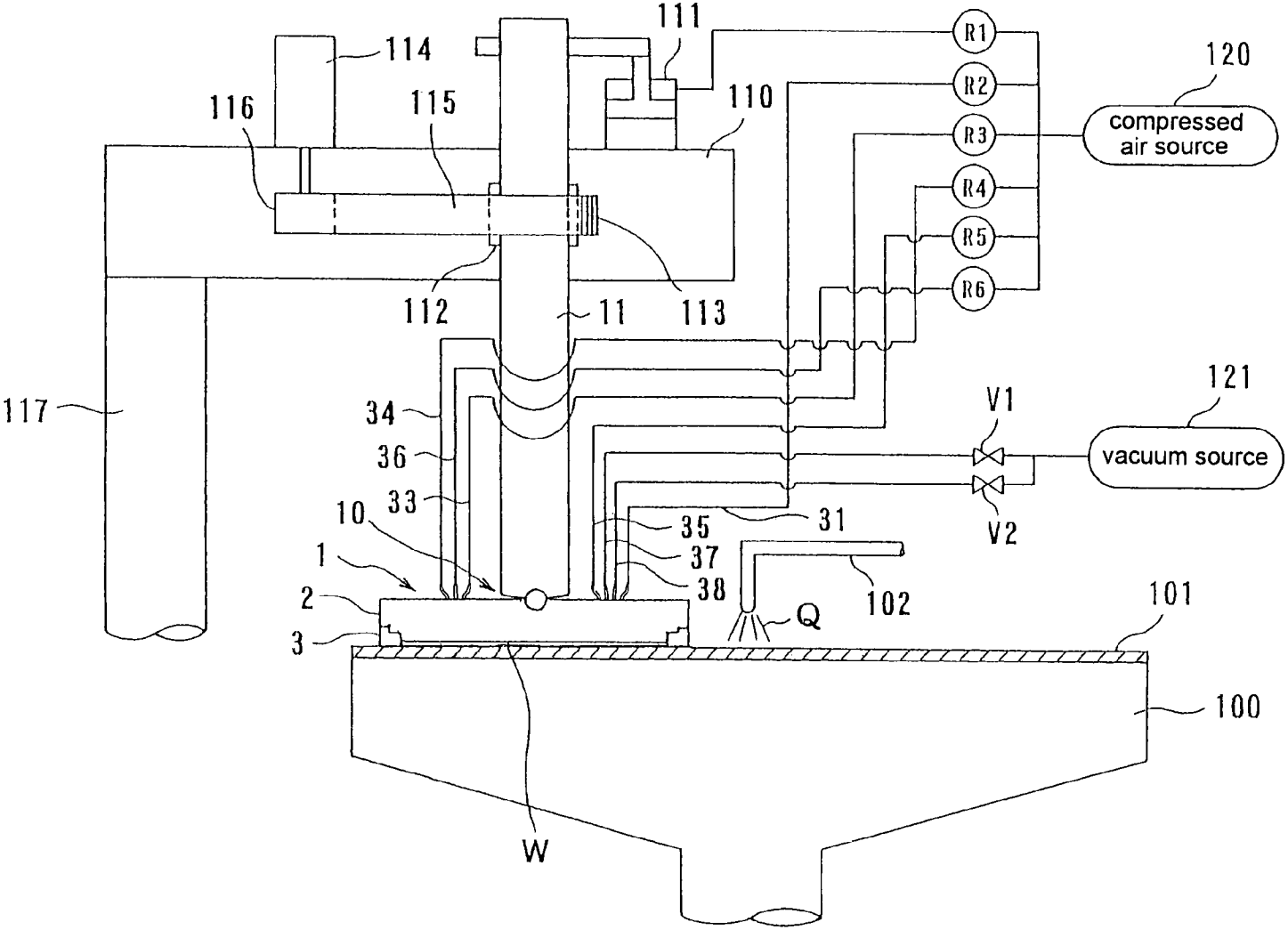
FIG. 1 is a cross-sectional view showing an entire arrangement of a polishing apparatus having a substrate holding apparatus according to the present invention.

FIG. 1 is a cross-sectional view showing an entire arrangement of a polishing apparatus having a substrate holding apparatus according to the present invention. The substrate holding apparatus serves to hold a substrate such as a semiconductor wafer to be polished and to press the substrate against a polishing surface on a polishing table. As shown in FIG. 1, a polishing table 100 having a polishing pad 101 attached on an upper surface thereof is provided underneath a top ring 1 constituting a substrate holding apparatus according to the present invention. A polishing liquid supply nozzle 102 is provided above the polishing table 100, and a polishing liquid Q is supplied onto the polishing pad 101 on the polishing table 100 from the polishing liquid supply nozzle 102.

Various kinds of polishing pads are available on the market. For example, some of these are SUBA800, IC-1000, and IC-1000/SUBA400 (two-layer cloth) manufactured by Rodel Inc., and Surfin xxx-5 and Surfin 000 manufactured by Fujimi Inc. SUBA800, Surfin xxx-5, and Surfin 000 are non-woven fabrics bonded by urethane resin, and IC-1000 is made of rigid foam polyurethane (single-layer). Foam polyurethane is porous and has a large number of fine recesses or holes formed in its surface.

The top ring 1 is connected to a top ring drive shaft 11 by a universal joint 10, and the top ring drive shaft 11 is coupled to a top ring air cylinder 111 fixed to a top ring head 110. The top ring air cylinder 111 operates to move the top ring drive shaft 11 vertically to thereby lift and lower the top ring 1 as a whole and to press a retainer ring 3 fixed to a lower end of a top ring body 2 against the polishing pad 101. The top ring air cylinder 111 is connected to a compressed air source 120 via a regulator R1, which can regulate pressure of compressed air or the like which is supplied to the top ring air cylinder 111. Thus, it is possible to adjust a pressing force to press the polishing pad 101 with the retainer ring 3.

The top ring drive shaft 11 is connected to a rotary sleeve 112 by a key (not shown). The rotary sleeve 112 has a timing pulley 113 fixedly disposed at a peripheral portion thereof. A top ring motor 114 is fixed to the top ring head 110, and the timing pulley 113 is coupled to a timing pulley 116 mounted on the top ring motor 114 via a timing belt 115. Therefore, when the top ring motor 114 is energized for rotation, the rotary sleeve 112 and the top ring drive shaft 11 are rotated in unison with each other via the timing pulley 116, the timing belt 115, and the timing pulley 113 to thereby rotate the top ring 1. The top ring head 110 is supported on a top ring head shaft 117 fixedly supported on a frame (not shown).

Figure 2:
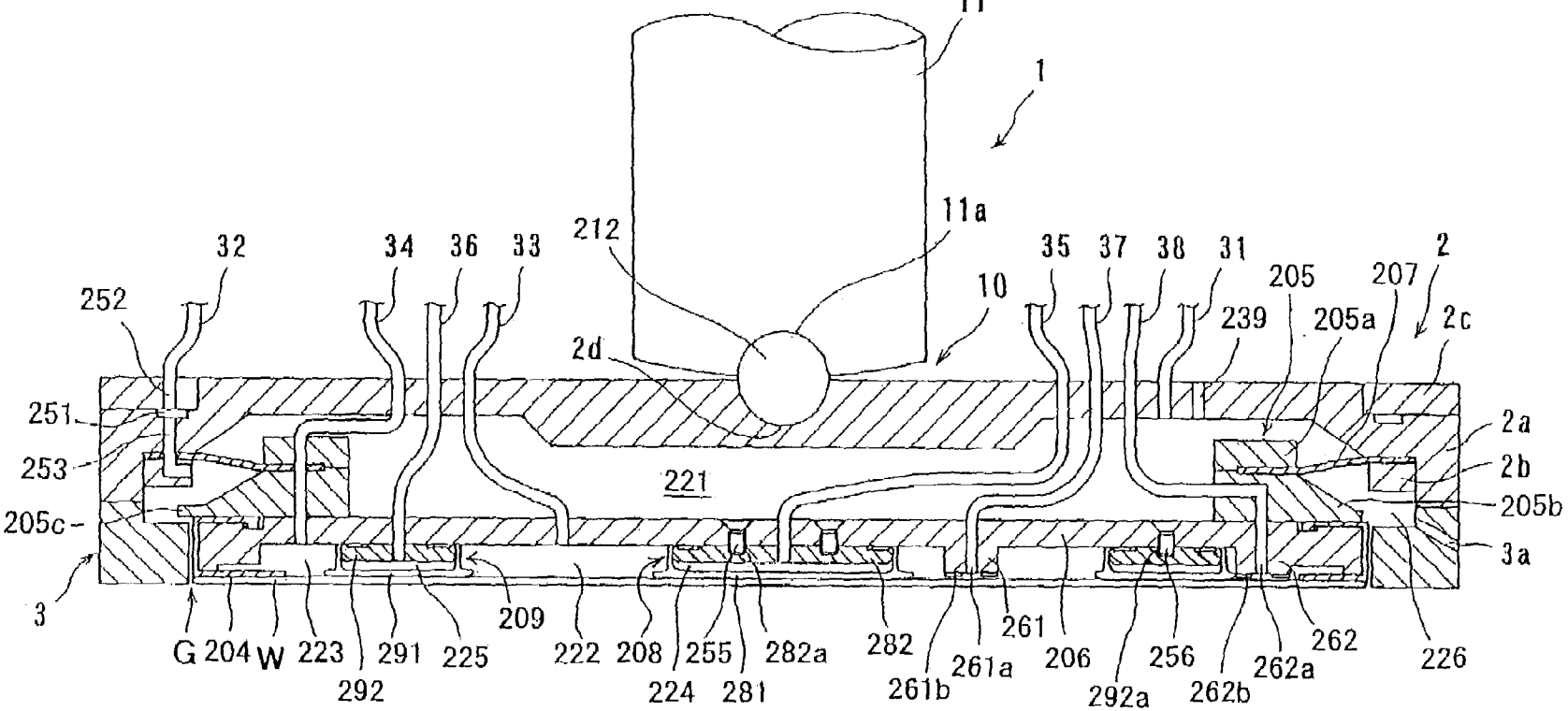
FIG. 2 is a vertical cross-sectional view showing a substrate holding apparatus according to a first embodiment of the present invention.
Figure 3:
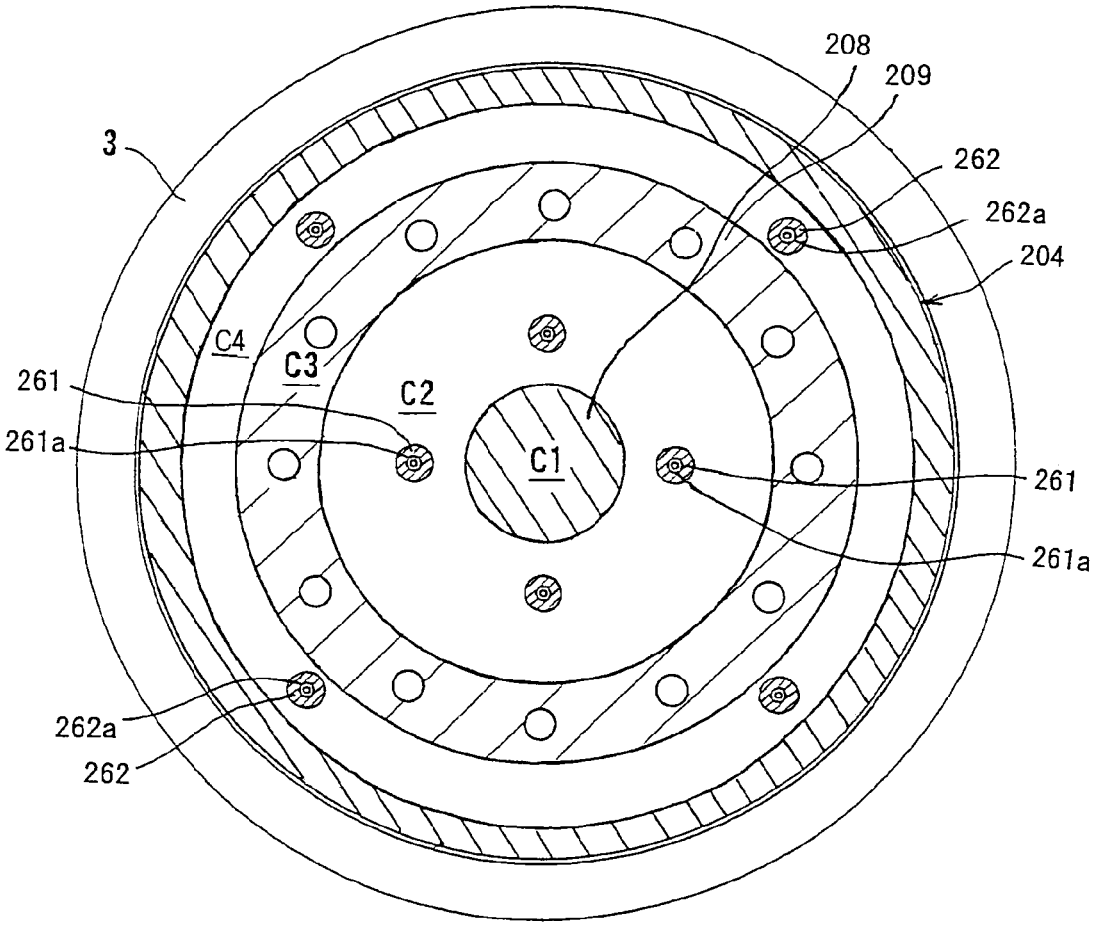
FIG. 3 is a bottom view of the substrate holding apparatus shown in FIG. 2.

Next, a substrate holding apparatus according to a first embodiment of the present invention will be described below. FIG. 2 is a vertical cross-sectional view showing top ring 1 of the substrate holding apparatus according to the first embodiment, and FIG. 3 is a bottom view of the top ring 1 shown in FIG. 2. As shown in FIG. 2, the top ring 1 constituting a substrate holding apparatus comprises a top ring body 2 in the form of a cylindrical housing with a receiving space defined therein, and a retainer ring 3 fixed to a lower end of the top ring body 2. The top ring body 2 is made of a material having high strength and rigidity, such as metal or ceramic. The retainer ring 3 is made of highly rigid synthetic resin, ceramic, or the like.

The top ring body 2 comprises a cylindrical housing 2*a*, an annular pressurizing sheet support 2*b* fitted into a cylindrical portion of the housing 2*a*, and an annular seal 2*c* fitted over an outer circumferential edge of an upper surface of the housing 2*a*. The retainer ring 3 is fixed to the lower end of the housing 2*a* of the top ring body 2. The retainer ring 3 has a lower portion projecting radially inwardly. The retainer ring 3 may be formed integrally with the top ring body 2.

Top ring drive shaft 11 is disposed above a central portion of the housing 2*a* of the top ring body 2, and the top ring body 2 is coupled to the top ring drive shaft 11 by universal joint 10. The universal joint 10 has a spherical bearing mechanism by which the top ring body 2 and the top ring drive shaft 11 are tiltable with respect to each other, and a rotation transmitting mechanism for transmitting rotation of the top ring drive shaft 11 to the top ring body 2. The spherical bearing mechanism and the rotation transmitting mechanism transmit a pressing force and a rotating force from the top ring drive shaft 11 to the top ring body 2 while allowing the top ring body 2 and the top ring drive shaft 11 to be tilted with respect to each other.

The spherical bearing mechanism comprises a hemispherical concave recess 11*a* defined centrally in a lower surface of the top ring drive shaft 11, a hemispherical concave recess 2*d* defined centrally in an upper surface of the housing 2*a*, and a ball bearing 212 made of a highly hard material such as ceramic and interposed between the concave recesses 11*a* and 2*d*. On the other hand, the rotation transmitting mechanism comprises drive pins (not shown) fixed to the top ring drive shaft 11, and driven pins (not shown) fixed to the housing 2*a*. Even if the top ring body 2 is tilted with respect to the top ring drive shaft 11, the drive pins and the driven pins remain in engagement with each other while contact points are displaced because the drive pins and the driven pins are vertically movable relatively to each other. Thus, the rotation transmitting mechanism reliably transmits rotational torque of the top ring drive shaft 11 to the top ring body 2.

The top ring body 2 and the retainer ring 3 secured to the top ring body 2 have a space defined therein, which accommodates therein a seal ring 204 having a lower surface brought into contact with a peripheral portion of a semiconductor wafer W held by the top ring 1, an annular holder ring 205, and a disk-shaped chucking plate 206 (vertically movable member) which is vertically movable within the receiving space in the top ring body 2. The seal ring 204 has a radially outer edge clamped between the holder ring 205 and the chucking plate 206 secured to a lower end of the holder ring 205 and extends radially inwardly so as to cover a lower surface of the chucking plate 206 near its outer circumferential edge. A lower end surface of the seal ring 204 is brought into contact with an upper surface of the semiconductor wafer W to be polished. The semiconductor wafer W has a recess defined in an outer edge thereof, which is referred to as a notch or orientation flat, for recognizing (identifying) an orientation of the semiconductor wafer. The seal ring 204 should preferably extend radially inwardly of the chucking plate 206 from an innermost position of such notch or orientation flat.

The chucking plate 206 may be made of metal. However, when a thickness of a thin film formed on a surface of a semiconductor wafer is measured by a method using eddy current in a state such that this semiconductor wafer to be polished is held by the top ring, the chucking plate 206 should preferably be made of a non-magnetic material, e.g., an insulating material such as fluororesin, epoxy resin, or ceramic.

A pressurizing sheet 207 comprising an elastic membrane extends between the holder ring 205 and the top ring body 2. The pressurizing sheet 207 has a radially outer edge clamped between the housing 2*a* and the pressurizing sheet support 2*b* of the top ring body 2, and a radially inner edge clamped between an upper end portion 205*a* and a stopper 205*b* of the holder ring 205. The top ring body 2, the chucking plate 206, the holder ring 205, and the pressurizing sheet 207 jointly define a pressure chamber 221 in the top ring body 2. As shown in FIG. 2, a fluid passage 31 comprising tubes and connectors communicates with the pressure chamber 221, which is connected to compressed air source 120 via a regulator R2 provided in the fluid passage 31. The pressurizing sheet 207 is made of a highly strong and durable rubber material such as ethylene propylene rubber (EPDM), polyurethane rubber, or silicone rubber.

In a case where the pressurizing sheet 207 is made of an elastic material such as rubber, if the pressurizing sheet 207 is fixedly clamped between the retainer ring 3 and the top ring body 2, then a desired horizontal surface cannot be maintained on a lower surface of the retainer ring 3 because of elastic deformation of the pressurizing sheet 207 as an elastic material. In order to prevent such a drawback, the pressurizing sheet 207 is clamped between the housing 2*a* of the top ring body 2 and the pressurizing sheet support 2*b* provided as a separate member in the present embodiment. The retainer ring 3 may vertically be movable with respect to the top ring body 2, or the retainer ring 3 may have a structure capable of pressing the polishing surface independently of the top ring body 2. In such cases, the pressurizing sheet 207 is not necessarily fixed in the aforementioned manner.

A cleaning liquid passage 251 in the form of an annular groove is defined in an upper surface of the housing 2*a* near its outer circumferential edge over which the seal 2*c* of the top ring body 2 is fitted. The cleaning liquid passage 251 communicates with a fluid passage 32 via a through-hole 252 formed in the seal 2*c*, and is supplied with a cleaning liquid (pure water) via the fluid passage 32. A plurality of communication holes 253 are defined in the housing 2*a* and the pressurizing sheet support 2*b* in communication with the cleaning liquid passage 251. The communication holes 253 communicate with a small gap G defined between an outer circumferential surface of the seal ring 204 and an inner circumferential surface of the retainer ring 3.

A central bag 208 and a ring tube 209 which serve as abutment members brought into contact with the semiconductor wafer W are mounted in a space defined between the chucking plate 206 and the semiconductor wafer W. In the present embodiment, as shown in FIGS. 2 and 3, the central bag 208 is disposed centrally on a lower surface of the chucking plate 206, and the ring tube 209 is disposed radially outwardly of the central bag 208 in a surrounding relationship relative thereto. Each of the seal ring 204, the central bag 208, and the ring tube 209 is made of a highly strong and durable rubber material such as ethylene propylene rubber (EPDM), polyurethane rubber, or silicone rubber.

A space defined between the chucking plate 206 and the semiconductor wafer W is divided into a plurality of spaces by the central bag 208 and the ring tube 209. Accordingly, a pressure chamber 222 is defined between the central bag 208 and the ring tube 209, and a pressure chamber 223 is defined radially outwardly of the ring tube 209.

The central bag 208 comprises an elastic membrane 281 brought into contact with the upper surface of the semiconductor wafer W, and a central bag holder 282 for detachably holding the elastic membrane 281 in position. The central bag holder 282 has threaded holes 282*a* defined therein, and the central bag 208 is detachably fastened to a center of the lower surface of the chucking plate 206 by screws 255 threaded into the threaded holes 282*a*. The central bag 208 has a central pressure chamber 224 defined therein by the elastic membrane 281 and the central bag holder 282.

Similarly, the ring tube 209 comprises an elastic membrane 291 brought into contact with the upper surface of the semiconductor wafer W, and a ring tube holder 292 for detachably holding the elastic membrane 291 in position. The ring tube holder 292 has threaded holes 292*a* defined therein, and the ring tube 209 is detachably fastened to the lower surface of the chucking plate 206 by screws 256 threaded into the threaded holes 292*a*. The ring tube 209 has an intermediate pressure chamber 225 defined therein by the elastic membrane 291 and the ring tube holder 292.

In the present embodiment, the pressure chamber 224 is formed by the elastic membrane 281 of the central bag 208 and the central bag holder 282, and the pressure chamber 225 is formed by the elastic membrane 291 of the ring tube 209 and the ring tube holder 292. The pressure chambers 222, 223 may also be formed by an elastic membrane and a holder for fixing the elastic membrane, respectively. Further, elastic membranes and holders may appropriately be added to increase a number of pressure chambers.

Fluid passages 33, 34, 35 and 36 comprising tubes and connectors communicate with the pressure chambers 222 and 223, the central pressure chamber 224, and the intermediate pressure chamber 225, respectively. The pressure chambers 222 to 225 are connected to the compressed air source 120 as a supply source via respective regulators R3, R4, R5 and R6 connected respectively to the fluid passages 33 to 36. The fluid passages 31 to 36 are connected to the respective regulators R1 to R6 through a rotary joint (not shown) mounted on an upper end of the top ring shaft 110.

The pressure chamber 221 above the chucking plate 206 and the pressure chambers 222 to 225 are supplied with pressurized fluids such as pressurized air or atmospheric air or evacuated, via the fluid passages 31, 33, 34, 35 and 36 connected to respective pressure chambers. As shown in FIG. 1, the regulators R2 to R6 connected to the fluid passages 31, 33, 34, 35 and 36 of the pressure chambers 221 to 225 can respectively regulate pressures of the pressurized fluids supplied to the respective pressure chambers. Thus, it is possible to independently control the pressures in the pressure chambers 221 to 225 or independently introduce atmospheric air or vacuum into the pressure chambers 221 to 225. In this manner, the pressures in the pressure chambers 221 to 225 are independently varied with the regulators R2 to R6, so that pressing forces to press the semiconductor wafer W against the polishing pad 101 can be adjusted in local areas of the semiconductor wafer W. In some applications, the pressure chambers 221 to 225 may be connected to a vacuum source 121.

In this case, the pressurized fluid or the atmospheric air supplied to the pressure chambers 222 to 225 may independently be controlled in terms of temperature. With this configuration, it is possible to directly control a temperature of a workpiece such as a semiconductor wafer from a backside of a surface to be polished. Particularly, when each of the pressure chambers is independently controlled in terms of temperature, a rate of chemical reaction can be controlled during a chemical polishing process of CMP.

The chucking plate 206 has radially inner suction portions 261 extended downwardly therefrom between the central bag 208 and the ring tube 209. The chucking plate 206 has radially outer suction portions 262 extended downwardly therefrom outside of the ring tube 209. In the present embodiment, eight suction portions 261, 262 are provided.

The inner suction portions 261 and the outer suction portions 262 have communication holes 261*a*, 262*a* communicating with fluid passages 37, 38, respectively. The inner suction portions 261 and the outer suction portions 262 are connected to the vacuum source 121 such as a vacuum pump via the fluid passages 37, 38 and valves V1, V2. When the communication holes 261*a*, 262*a* of the suction portions 261, 262 are connected to the vacuum source 121, a negative pressure is developed at lower opening ends of the communication holes 261*a*, 262*a* thereof to attract a semiconductor wafer W to lower ends of the inner suction portions 261 and the outer suction portions 262. The inner suction portions 261 and the outer suction portions 262 have elastic sheets 261*b*, 262*b*, such as thin rubber sheets, attached to their lower ends, for thereby elastically contacting and holding the semiconductor wafer W on lower surfaces thereof.

Since there is a small gap G between the outer circumferential surface of the seal ring 204 and the inner circumferential surface of the retainer ring 3, the holder ring 205, the chucking plate 206, and the seal ring 204 attached to the chucking plate 206 can vertically be moved with respect to the top ring body 2 and the retainer ring 3, and hence are of a floating structure with respect to the top ring body 2 and the retainer ring 3. The stopper 205*b* of the holder ring 205 has a plurality of teeth 205*c* projecting radially outwardly from an outer circumferential edge thereof. Downward movement of members including the holder ring 205 is limited to a predetermined range by engaging the teeth 205*c* with an upper surface of the radially inwardly projecting portion of the retainer ring 3.

Next, operation of the top ring 1 thus constructed will be described in detail below.

In the polishing apparatus constructed above, when a semiconductor wafer W is to be delivered to the polishing apparatus, the top ring 1 as a whole is moved to a position to which the semiconductor wafer W is transferred, and the communication holes 261*a*, 262*a* of the inner suction portions 261 and the outer suction portions 262 are connected via the fluid passages 37, 38 to the vacuum source 121. The semiconductor wafer W is attracted under vacuum to the lower ends of the inner suction portions 261 and the outer suction portions 262 by suction effect of the communication holes 261*a*, 262*a*. With the semiconductor wafer W attracted to the top ring 1, the top ring 1 as a whole is moved to a position above the polishing table 100 having a polishing surface (polishing pad 101) thereon. An outer circumferential edge of the semiconductor wafer W is held by the retainer ring 3 so that the semiconductor wafer W is not removed from the top ring 1.

For polishing the semiconductor wafer W, attraction of semiconductor wafer W by the suction portions 261, 262 is released, and the semiconductor wafer W is held on a lower surface of the top ring 1. Simultaneously, the top ring air cylinder 111 connected to the top ring drive shaft 11 is actuated to press the retainer ring 3 fixed to a lower end of the top ring 1 against the polishing surface on the polishing table 100 under a predetermined pressure. In such a state, pressurized fluids are respectively supplied to the pressure chambers 222, 223, the central pressure chamber 224, and the intermediate pressure chamber 225 under respective pressures, thereby pressing the semiconductor wafer W against the polishing surface on the polishing table 100. The polishing liquid supply nozzle 102 supplies a polishing liquid Q onto the polishing pad 101 in advance, so that the polishing liquid Q is held on the polishing pad 101. Thus, the semiconductor wafer W is polished by the polishing pad 101 with the polishing liquid Q being present between a (lower) surface, to be polished, of the semiconductor wafer W and the polishing pad 101.

Local areas of the semiconductor wafer W that are positioned beneath the pressure chambers 222, 223 are pressed against the polishing surface under pressures of the pressurized fluids supplied to the pressure chambers 222, 223. A local area of the semiconductor wafer W that is positioned beneath the central pressure chamber 224 is pressed via the elastic membrane 281 of the central bag 208 against the polishing surface under pressure of the pressurized fluid supplied to the central pressure chamber 224. A local area of the semiconductor wafer W that is positioned beneath the intermediate pressure chamber 225 is pressed via the elastic membrane 291 of the ring tube 209 against the polishing surface under pressure of the pressurized fluid supplied to the intermediate pressure chamber 225.

Therefore, polishing pressures acting on respective local areas of the semiconductor wafer W can be adjusted independently by controlling pressures of the pressurized fluids supplied to the respective pressure chambers 222 to 225. Specifically, the respective regulators R3 to R6 independently regulate the pressures of the pressurized fluids supplied to the pressure chambers 222 to 225 for thereby adjusting pressing forces applied to press the local areas of the semiconductor wafer W against the polishing pad 101 on the polishing table 100. With the polishing pressures on the respective local areas of the semiconductor wafer W being adjusted independently to desired values, the semiconductor wafer W is pressed against the polishing pad 101 on the polishing table 100 that is being rotated. Similarly, pressure of the pressurized fluid supplied to the top ring air cylinder 111 can be regulated by the regulator R1 to adjust a force with which the retainer ring 3 presses the polishing pad 101. While the semiconductor wafer W is being polished, the force with which the retainer ring 3 presses the polishing pad 101 and the pressing force with which the semiconductor wafer W is pressed against the polishing pad 101 can appropriately be adjusted for thereby applying polishing pressures in a desired pressure distribution to a central area (C1 in FIG. 3), an inner area (C2) between the central area and an intermediate area, the intermediate area (C3), a peripheral area (C4) of the semiconductor wafer W, and a peripheral portion of the retainer ring 3 which is positioned outside of the semiconductor wafer W.

In this manner, the semiconductor wafer W is divided into four concentric circular and annular areas (C1 to C4), which can respectively be pressed under independent pressing forces. A polishing rate depends on a pressing force applied to a semiconductor wafer W against a polishing surface. As described above, since the pressing forces applied to those areas can independently be controlled, polishing rates of the four circular and annular areas (C1 to C4) of the semiconductor wafer W can independently be controlled. Consequently, even if a thickness of a thin film to be polished on the surface of the semiconductor wafer W suffers radial variations, the thin film on the surface of the semiconductor wafer W can be polished uniformly without being insufficiently or excessively polished over an entire surface of the semiconductor wafer. More specifically, even if the thickness of the thin film to be polished on the surface of the semiconductor wafer W differs depending on a radial position of the semiconductor wafer W, pressure in a pressure chamber positioned over a thicker area of the thin film is made higher than pressure in other pressure chambers, or pressure in a pressure chamber positioned over a thinner area of the thin film is made lower than pressure in other pressure chambers. In this manner, a pressing force applied to the thicker area of the thin film against the polishing surface is made higher than a pressing force applied to the thinner area of the thin film against the polishing surface, thereby selectively increasing a polishing rate of the thicker area of the thin film. Consequently, the entire surface of the semiconductor wafer W can be polished exactly to a desired level over the entire surface of the semiconductor wafer W irrespective of a film thickness distribution produced at a time the thin film is formed.

Any unwanted edge rounding on a circumferential edge of the semiconductor wafer W can be prevented by controlling a pressing force applied to the retainer ring 3. If the thin film to be polished on the circumferential edge of the semiconductor wafer W has large thickness variations, then the pressing force applied to the retainer ring 3 is intentionally increased or reduced to thus control a polishing rate of the circumferential edge of the semiconductor wafer W. When the pressurized fluids are supplied to the pressure chambers 222 to 225, the chucking plate 206 is subjected to upward forces. In the present embodiment, pressurized fluid is supplied to the pressure chamber 221 via the fluid passage 31 to prevent the chucking plate 206 from being lifted under these forces due to the pressure chambers 222 to 225.

As described above, the pressing force applied by the top ring air cylinder 111 to press the retainer ring 3 against the polishing pad 101, and the pressing forces applied by the pressurized air supplied to the pressure chambers 222 to 225 to press the local areas of the semiconductor wafer W against the polishing pad 101, are appropriately adjusted to polish the semiconductor wafer W. When polishing of the semiconductor wafer W is finished, the semiconductor wafer W is attracted to the lower ends of the inner suction portions 261 and the outer suction portions 262 under vacuum in the same manner as described above. At this time, supply of the pressurized fluids into the pressure chambers 222 to 225 to press the semiconductor wafer W against the polishing surface is stopped, and the pressure chambers 222 to 225 are vented to an atmosphere. Accordingly, the lower ends of the inner suction portions 261 and the outer suction portions 262 are brought into contact with the semiconductor wafer W. The pressure chamber 221 is vented to the atmosphere or evacuated to develop a negative pressure therein. If the pressure chamber 221 is maintained at a high pressure, then the semiconductor wafer W is strongly pressed against the polishing surface only in areas brought into contact with the inner suction portions 261 and the outer suction portions 262. Therefore, it is necessary to decrease pressure in the pressure chamber 221 immediately. Accordingly, a relief port 239 penetrating from the pressure chamber 221 through the top ring body 2 may be provided for decreasing the pressure in the pressure chamber 221 immediately, as shown in FIG. 2. In this case, when the pressure chamber 221 is pressurized, it is necessary to continuously supply pressurized fluid into the pressure chamber 221 via the fluid passage 31. The relief port 239 comprises a check valve for preventing an outside air from flowing into the pressure chamber 221 at a time when a negative pressure is developed in the pressure chamber 221.

After attraction of the semiconductor wafer W, the top ring 1 as a whole is moved to a position to which the semiconductor wafer W is to be transferred, and then a fluid (e.g., compressed air or a mixture of nitrogen and pure water) is ejected to the semiconductor wafer W via the communication holes 261*a*, 262*a* of the inner suction portions 261 and the outer suction portions 262 to release the semiconductor wafer W from the top ring 1.

The polishing liquid Q used to polish the semiconductor wafer W tends to flow through the small gap G between the outer circumferential surface of the seal ring 204 and the retainer ring 3. If the polishing liquid Q is firmly deposited in the gap G, then the holder ring 205, the chucking plate 206, and the seal ring 204 are prevented from smoothly moving vertically with respect to the top ring body 2 and the retainer ring 3. To avoid such a drawback, a cleaning liquid (pure water) is supplied through the fluid passage 32 to the cleaning liquid passage 251. Accordingly, the pure water is supplied via a plurality of communication holes 253 to a region above the gap G, thus cleaning the gap G to prevent the polishing liquid Q from being firmly deposited in the gap G. The pure water should preferably be supplied after a polished semiconductor wafer W is released and until a next semiconductor wafer to be polished is attracted to the top ring 1. It is also preferable to discharge all supplied pure water out of the top ring 1 before the next semiconductor wafer is polished, and hence to provide the retainer ring 3 with a plurality of through-holes 3*a* shown in FIG. 2. Furthermore, if a pressure buildup is developed in a space 226 defined between the retainer ring 3, the holder ring 205, and the pressurizing sheet 207, then it acts to prevent the chucking plate 206 from being elevated in the top ring body 2. Therefore, in order to allow the chucking plate 206 to be elevated smoothly in the top ring body 2, the through-holes 3*a* should preferably be provided for equalizing pressure in the space 226 with atmospheric pressure.

As described above, according to a substrate holding apparatus of the first embodiment, the pressures in the pressure chambers 222, 223, pressure chamber 224 in the central bag 208, and the pressure chamber 225 in the ring tube 209 are independently controlled to control pressing forces acting on the semiconductor wafer W.

A first example of the ring tube 209 in the substrate holding apparatus according to the first embodiment of the present invention will be described in detail below. Although only the ring tube 209 will be described below, the following description can be applied to the central bag 208.

Figure 4:
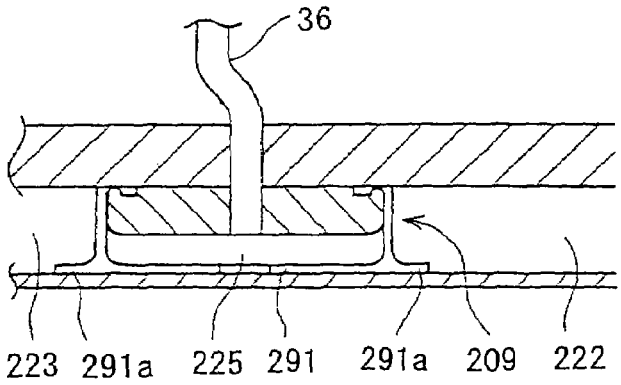
FIG. 4 is a vertical cross-sectional view showing a first example of a ring tube in the substrate holding apparatus according to the first embodiment of the present invention.
Figure 5:
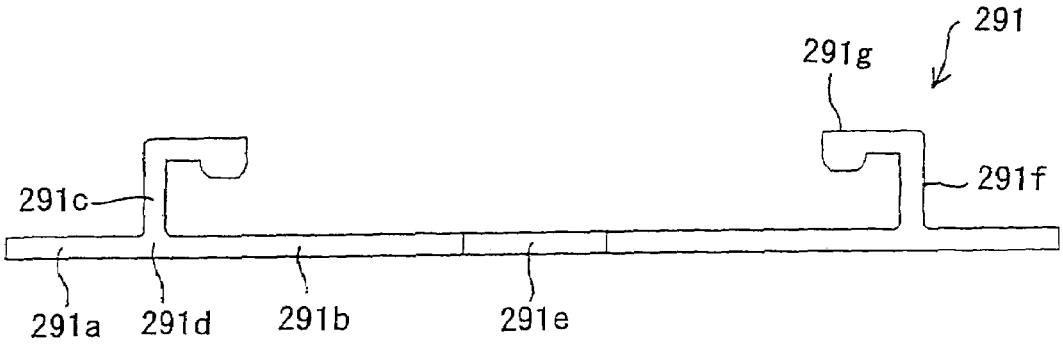
FIG. 5 is a vertical cross-sectional view showing an elastic membrane of the ring tube shown in FIG. 4.

FIG. 4 is a vertical cross-sectional view showing the ring tube 209 shown in FIG. 2, and FIG. 5 is a vertical cross-sectional view showing the elastic membrane 291 of the ring tube 209 shown in FIG. 4. As shown in FIGS. 4 and 5, the elastic membrane 291 of the ring tube 209 in a first example has an abutment portion 291*b* having flanges 291*a* projecting outwardly and inwardly, and connecting portions 291*c* connected via the ring tube holder 292 to the chucking plate 206. The connecting portions 291*c* extend upwardly from base portions 291*d* of the flanges 291*a*. A lower surface of the abutment portion 291*b* is brought into contact with the upper surface of the semiconductor wafer W. The flanges 291*a*, the abutment portion 291*b*, and the connecting portions 291*c* are integrally made of the same material.

As described above, when a semiconductor wafer is polished, pressurized fluids are supplied to the pressure chamber 222, and the pressure chamber 223 surrounding the ring tube 209. Thus, the flanges 291*a* are brought into close contact with the semiconductor wafer W by pressurized fluids supplied to the pressure chambers 222, 223. Accordingly, even if pressure of the pressurized fluid supplied to the pressure chamber 222 or 223 surrounding the pressure chamber 225 is considerably higher than pressure of the pressurized fluid supplied to the pressure chamber 225 defined in the ring tube 209, high-pressure fluid surrounding the pressure chamber 225 is prevented from flowing into a lower portion of the ring tube 209. Therefore, the flanges 291*a* can widen a range of pressure control in each of the pressure chambers, for thereby pressing the semiconductor wafer more stably.

Openings 291*e* are formed in central portions of the abutment portion 291*b* of the ring tube 209, and thus a pressurized fluid supplied to the intermediate pressure chamber 225 directly contacts with the upper surface of the semiconductor wafer W through the openings 291*e* of the abutment portion 291*b*. Since a pressurized fluid is supplied to the intermediate pressure chamber 225 during polishing, the pressurized fluid presses the abutment portion 291*b* of the ring tube 209 against the upper surface of the semiconductor wafer W. Therefore, even if the openings 291*e* are formed in the abutment portion 291*b*, a pressurized fluid in the intermediate pressure chamber 225 hardly flows out to an exterior of the intermediate pressure chamber 225. Further, when the semiconductor wafer W is released, a downward pressure can be applied through the openings 291*e* to the semiconductor wafer W by a pressurized fluid, so that the semiconductor wafer W can more smoothly be released.

When the pressurized fluid supplied to the intermediate pressure chamber 225 is controlled in terms of temperature and a temperature of the semiconductor wafer W is controlled from a backside of the wafer to be polished, as described above, the openings 291*e* formed in the abutment portion 291*b* of the ring tube 209 can increase an area in which the pressurized fluid controlled in terms of temperature is brought into contact with the semiconductor wafer W. Therefore, controllability in terms of temperature of the semiconductor wafer W can be improved. Further, when polishing of the semiconductor wafer W is finished and the semiconductor wafer W is released, the intermediate pressure chamber 225 is opened to outside air via the openings 291*e*. Thus, the fluid supplied into the intermediate pressure chamber 225 is prevented from remaining in the intermediate pressure chamber 225. Therefore, even if semiconductor wafers W are continuously polished, controllability in terms of temperature of the semiconductor wafer W can be maintained.

In a case where the aforementioned flanges 291*a* are provided at the abutment portion 291*b* of the ring tube 209, when a pressurized fluid is supplied to the pressure chamber 221 to press the chucking plate 206 downwardly for polishing, downward forces may excessively be applied to portions of the semiconductor wafer W near the base portions 291*d* of the flanges 291*a* of the ring tube 209 by the connecting portions 291*c*, so that a polishing rate may be locally increased at these portions.

Figure 6A:
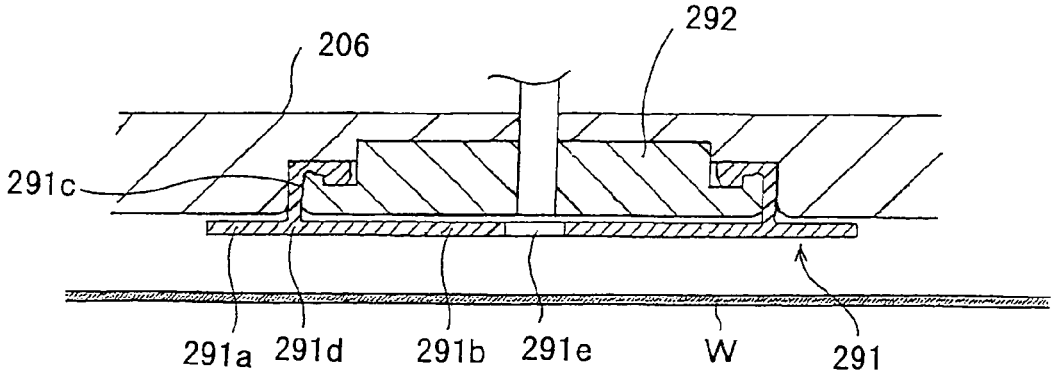
FIGS. 6A through 6C are vertical cross-sectional views showing deformation of the elastic membrane of the ring tube.
Figure 6B:
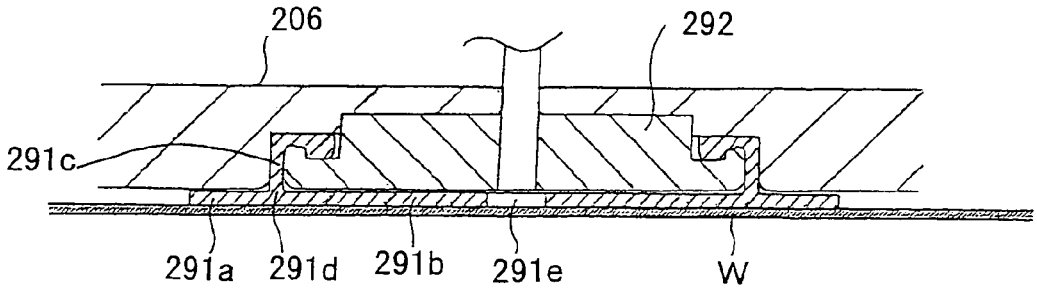
Figure 6C:
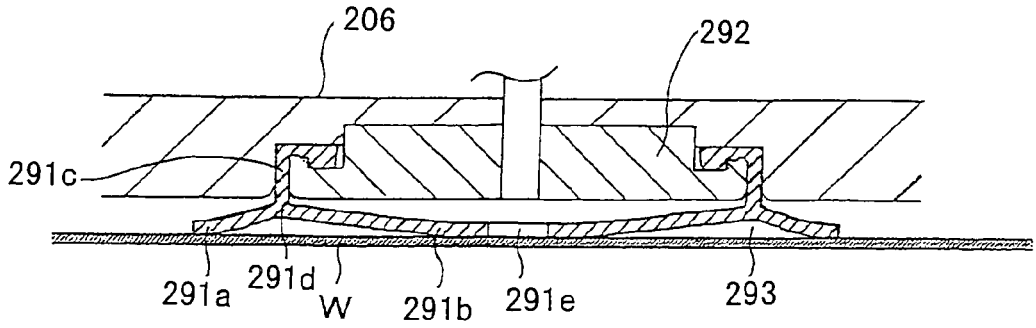

On the other hand, as shown in FIGS. 6A through 6C, in a case where, after the semiconductor wafer W is brought into close contact with the abutment portion 291*b* of the ring tube 209, the pressure chamber 221 is supplied with a pressure smaller than a sum of pressing forces applied to the pressure chambers 222 to 225 to polish the semiconductor wafer in such a state that the chucking plate 206 is lifted, upward forces may be applied to portions near the base portions 291*d* of the flanges 291*a* which are brought into close contact with the semiconductor wafer W by the connecting portions 291*c*. Thus, a vacuum 293 may be formed near the base portions 291*d* (see FIG. 6C), so that a polishing rate may be locally lowered at these portions.

In view of the above, in the present embodiment, the connecting portions 291*c* of the ring tube 209 are made of a soft material having a higher flexibility than the abutment portion 291*b*. With this configuration, even if the chucking plate 206 is downwardly pressed for polishing, excessive downward forces are not applied to the semiconductor wafer W which is brought into close contact with the abutment portion 291*b* because the connecting portions 291*c* are likely to be elastically deformed, so that a uniform polishing rate can be achieved over an entire surface of the abutment portion 291*b* except the flanges 291*a*. Further, even if the chucking plate 206 is lifted for polishing, excessive upward forces are not applied to the abutment portion 291*b* because the connecting portions 291*c* are likely to extend. Thus, a vacuum is not formed near the base portions 291*d* of the flanges 291*a*, so that a uniform polishing rate can be achieved over the entire surface of the abutment portion 291*b* except the flanges 291*a*. Only vertically extending portions 291*f* (see FIG. 5) of the connecting portions 291*c* may be made of a soft material having a high flexibility, or, in addition thereto, portions 291*g* held by the ring tube holder 292 may also be made of a soft material having a high flexibility.

Figure 7:
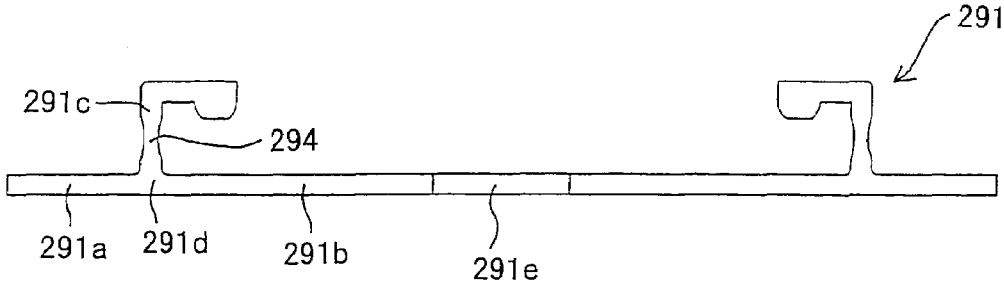
FIG. 7 is a vertical cross-sectional view showing a second example of an elastic membrane of a ring tube in a substrate holding apparatus according to the present invention.

FIG. 7 is a vertical cross-sectional view showing a second example of an elastic membrane of a ring tube in a substrate holding apparatus according to the present invention. In the ring tube of the second example, connecting portions 291*c* have thin portions 294 having a thickness smaller than a thickness of abutment portion 291*b*. The thin portions 294 are constricted inwardly as shown in FIG. 7. With such thin portions 294, even if chucking plate 206 is pressed downwardly for polishing, excessive downward forces are not applied to semiconductor wafer W which is brought into close contact with the abutment portion 291*b* because the connecting portions 291*c* are likely to be deformed at the thin portions 294, so that a uniform polishing rate can be achieved over an entire surface of the abutment portion 291*b* except flanges 291*a*. Further, even if the chucking plate 206 is lifted for polishing, excessive upward forces are not applied to the abutment portion 291*b* because the thin portions 294 are likely to extend. Thus, a vacuum is not formed near base portions 291*d* of the flanges 291*a*, so that a uniform polishing rate can be achieved over the entire surface of the abutment portion 291*b* except the flanges 291*a*. Particularly, when the thin portions 294 are formed so as to be constricted inwardly in cross-section, the above effects can effectively be achieved.

Figure 8:
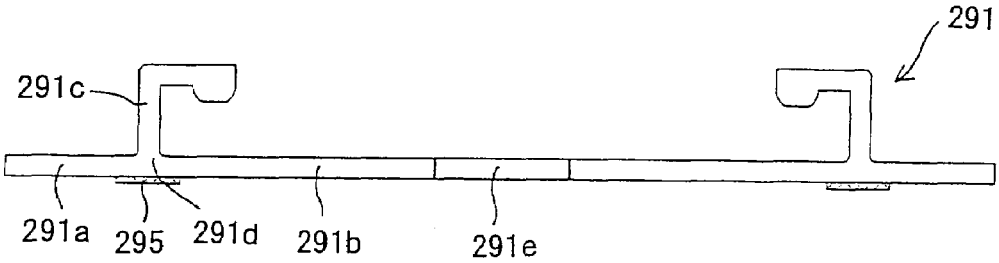
FIG. 8 is a vertical cross-sectional view showing a third example of an elastic membrane of a ring tube in a substrate holding apparatus according to the present invention.

FIG. 8 is a vertical cross-sectional view showing a third example of an elastic membrane of a ring tube in a substrate holding apparatus according to the present invention. In the ring tube of the third example, intermediate members 295 having a low adhesiveness to semiconductor wafer W are attached to lower surfaces of base portions 291*d* of flanges 291*a*. Any member can be used as intermediate member 295 as long as it has a low adhesiveness to the wafer W. For example, a cellophane tape may be used as the intermediate member 295. The intermediate member 295 should preferably be as thin as possible, and preferably have a thickness of at most 0.2 mm. With this arrangement, even if the chucking plate 206 is lifted for polishing, a vacuum is unlikely to be formed near the base portions 291*d* of the flanges 291*a* because the base portions 291*d* of the flanges 291*a* are unlikely to be brought into close contact with the semiconductor wafer W. Therefore, a uniform polishing rate can be achieved over an entire surface of abutment portion 291*b* except the flanges 291*a*. Instead of mounting such intermediate members 295, adhesiveness between the base portions 291*d* of the flanges 291*a* and the semiconductor wafer W may be weakened, for example, by forming a groove in lower surfaces of the base portions 291*d* of the flanges 291*a*, or by forming the lower surfaces of the base portions 291*d* as rough surfaces.

Figure 9:
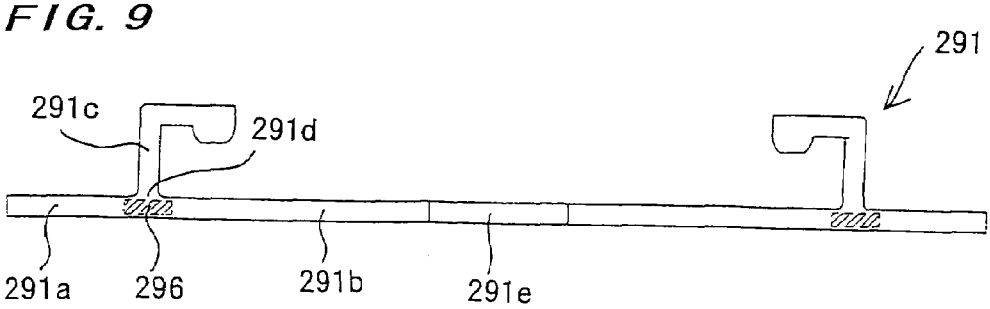
FIG. 9 is a vertical cross-sectional view showing a fourth example of an elastic membrane of a ring tube in a substrate holding apparatus according to the present invention.

FIG. 9 is a vertical cross-sectional view showing a fourth example of an elastic membrane of a ring tube in a substrate holding apparatus according to the present invention. In the ring tube of the fourth example, ring-like hard members 296 made of a material harder than elastic membrane 291 (e.g., stainless steel) are embedded in base portions 291*d* of flanges 291*a*. With this arrangement, even if chucking plate 206 is downwardly pressed for polishing, excessive downward forces are not applied to semiconductor wafer W which is brought into close contact with abutment portion 291*b* because downward forces by connecting portions 291*c* are dispersed by the hard members 296, so that a uniform polishing rate can be achieved over an entire surface of the abutment portion 291*b* except the flanges 291*a*. Further, even if chucking plate 206 is lifted for polishing, a vacuum is not formed near the base portions 291*d* of the flanges 291*a* because the hard members 296 prevent deformation of the vicinity of the base portions 291*d* of the flanges 291*a*. Therefore, a uniform polishing rate can be achieved over the entire surface of the abutment portion 291*b* except the flanges 291*a*.

Figure 10:
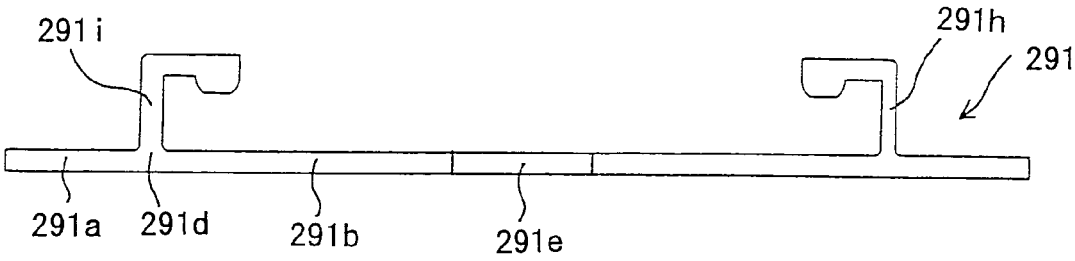
FIG. 10 is a vertical cross-sectional view showing a fifth example of an elastic membrane of a ring tube in a substrate holding apparatus according to the present invention.

FIG. 10 is a vertical cross-sectional view showing a fifth example of an elastic membrane of a ring tube in a substrate holding apparatus according to the present invention. The fifth example corresponds to an example of a ring tube in which a connecting portion 291*h* positioned radially inwardly, i.e., near a center of semiconductor wafer W, has a thickness smaller than that of a connecting portion 291*i* positioned radially outwardly, in the elastic membrane 291 of the ring tube of the first example. Because a cylinder having a smaller curvature generally has a stiffness larger than a cylinder having a larger curvature, a vertical force applied to the base portion of the flange by the connecting portion positioned radially inwardly becomes larger than a force applied to the base portion of the flange by the connecting portion positioned radially outwardly. Therefore, as shown in the fifth example, when the connecting portion 291*h* positioned radially inwardly is thinner than the connecting portion 291*i* positioned radially outwardly, vertical forces applied to the base portions of the flanges by these connecting portions 291*h*, 291*i* can be adjusted to the same level, and a uniform polishing rate can be achieved over an entire surface of abutment portion 291*b* except flanges 291*a*. When the connecting portion positioned radially inwardly is made of a material having a flexibility higher than that of material of the connecting portion positioned radially outwardly in the ring tube of the first example, similar effects are expected.

Figure 11:
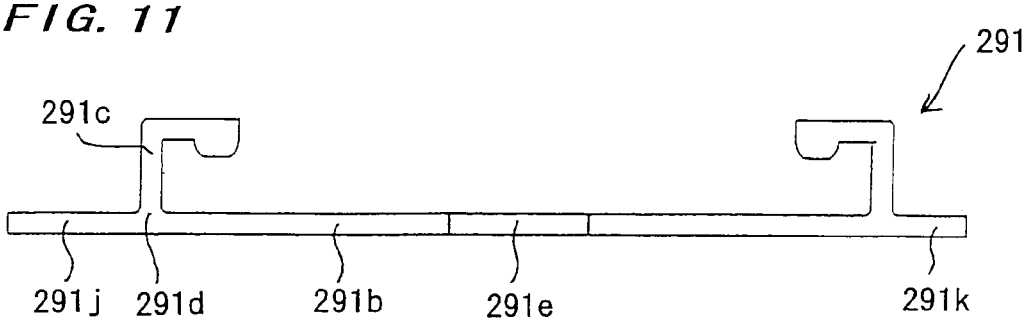
FIG. 11 is a vertical cross-sectional view showing a sixth example of an elastic membrane of a ring tube in a substrate holding apparatus according to the present invention.

FIG. 11 is a vertical cross-sectional view showing a sixth example of an elastic membrane of a ring tube in a substrate holding apparatus according to the present invention. The sixth example corresponds to an example of a ring tube in which a flange 291*j* projecting radially outwardly has a length larger than a flange 291*k* projecting radially inwardly, in the elastic membrane 291 of the ring tube of the first example. With this arrangement, a sealing capability can be enhanced at the flange 291*j* projecting radially outwardly, so that a uniform polishing rate can be achieved over an entire surface of abutment portion 291*b*.

Figure 12A:
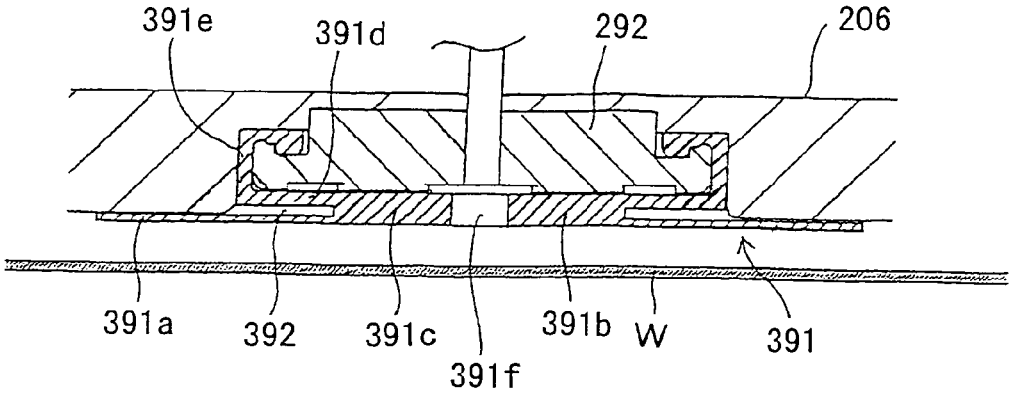
FIGS. 12A through 12C are vertical cross-sectional views showing a seventh example of an elastic membrane of a ring tube in a substrate holding apparatus according to the present invention.
Figure 12B:
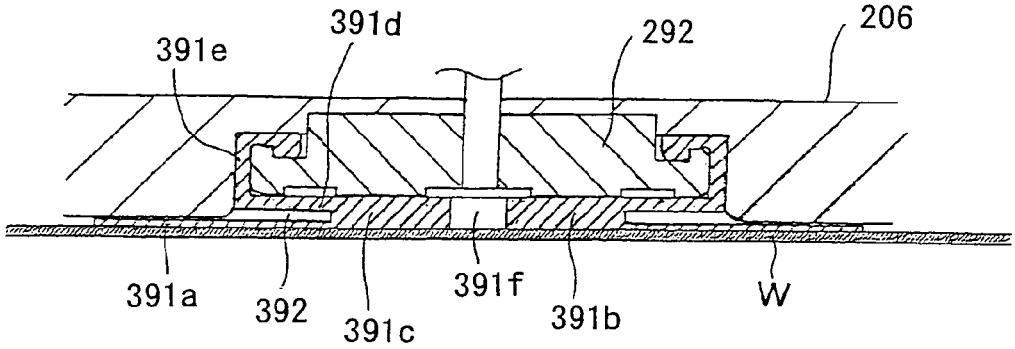
Figure 12C:
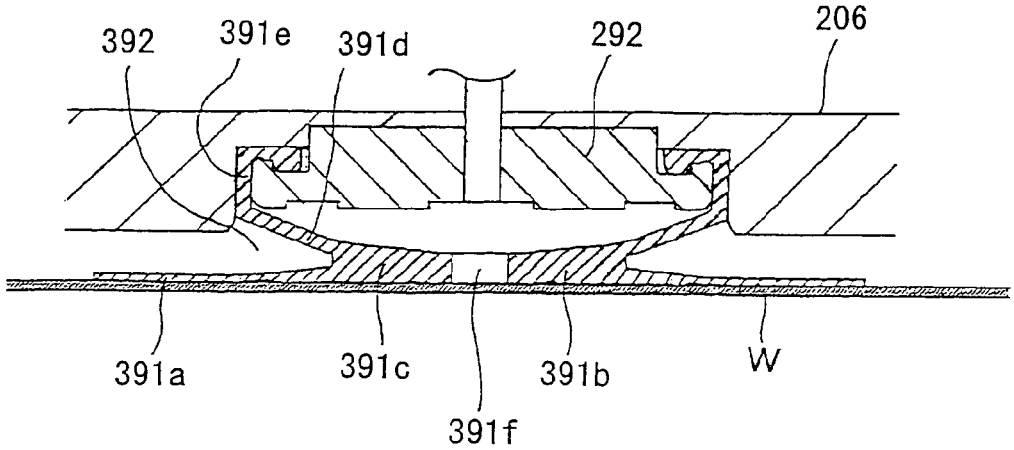

FIGS. 12A through 12C are vertical cross-sectional views showing a seventh example of a ring tube in a substrate holding apparatus according to the present invention. As shown in FIG. 12A, elastic membrane 391 of the ring tube of the seventh example has an abutment portion 391*b* having flanges 391*a* projecting outwardly, extending portions 391*d* extending outwardly from base portions 391*c* of the flanges 391*a* to form grooves 392 between the extending portions 391*d* and the flanges 391*a*, and connecting portions 391*e* connected via ring tube holder 292 to chucking plate 206. The extending portions 391*d* extend outwardly from the base portions 391*c* of the flanges 391*a* to positions inward of tips of the flanges 391*a*, and the connecting portions 391*e* extend upwardly from outward ends of the extending portions 391*d*. The flanges 391*a*, the abutment portion 391*b*, the connecting portions 391*e*, and the extending portions 391*d* are integrally made of the same material. An opening 391*f* is formed in a central portion of the abutment portion 391*b*.

With this arrangement, in a case where the chucking plate 206 is lifted for polishing after semiconductor wafer W is brought into close contact with the abutment portion 391*b* (see FIG. 12B), upward forces by the connecting portions 391*e* are converted into forces in horizontal or oblique directions by the extending portions 391*d*, and these converted forces are applied to the base portions 391*c* of the flanges 391*a* (see FIG. 12C). Therefore, upward forces applied to the base portions 391*c* of the flanges 391*a* can be made extremely small, so that excessive upward forces are not applied to the abutment portion 391*b*. Accordingly, a vacuum is not formed near the base portions 391*d*, so that a uniform polishing rate can be achieved over an entire surface of the abutment portion 391*b* except the flanges 391*a*. In this case, a thickness of the connecting portions 391*e* or a length of the flanges 391*a* may be varied between the connecting portion disposed radially inwardly and the connecting portion disposed radially outwardly, as with the ring tube in the fifth or sixth example. Further, the length of the extending portions 391*d* may be varied between the extending portion disposed radially inwardly and the extending portion disposed radially outwardly. Furthermore, a thickness of the flanges 391*a* may be varied according to a type of a film formed on a semiconductor wafer to be polished or the polishing pad. When resistance or polishing torque transmitted to the semiconductor wafer is large, the thickness of the flanges 391*a* should preferably be made larger in order to prevent torsion of the flanges 391*a*.

In the substrate holding apparatus according to the first embodiment described above, the fluid passages 31, 33, 34, 35 and 36 are provided as separate passages. However, these fluid passages may be combined with each other, or the pressure chambers may be communicated with each other in accordance with a magnitude of a pressing force to be applied to the semiconductor wafer W and a position to which the pressing force is applied. In the first embodiment, the central bag 208 and the ring tube 209 are brought into direct contact with the semiconductor wafer W. However, the present invention is not limited to such a configuration. For example, an elastic pad may be interposed between the central bag 208 and ring tube 209 and the semiconductor wafer W so that the central bag 208 and the ring tube 209 are brought into indirect contact with the semiconductor wafer W. Further, the above examples may appropriately be combined with each other.

In the substrate holding apparatus according to the first embodiment described above, the polishing surface is constituted by the polishing pad. However, the polishing surface is not limited to this. For example, the polishing surface may be constituted by a fixed abrasive. The fixed abrasive is formed into a flat plate comprising abrasive particles fixed by a binder. With the fixed abrasive used for polishing, a polishing process is performed by abrasive particles self-generated from the fixed abrasive. The fixed abrasive comprises abrasive particles, a binder, and pores. For example, cerium dioxide (CeO2) having an average particle diameter of 0.5 μm is used as an abrasive particle, and epoxy resin is used as a binder. Such a fixed abrasive forms a harder polishing surface. The fixed abrasive includes a fixed abrasive pad having a two-layer structure formed by a thin layer of a fixed abrasive and an elastic polishing pad attached to a lower surface of the layer of the fixed abrasive. IC-1000 described above may be used for another hard polishing surface.

As described above, according to the substrate holding apparatus of the first embodiment of the present invention, pressures to be applied to the substrate can independently be controlled, and hence a pressing force applied to a thicker area of a thin film can be made higher than a pressing force applied to a thinner area of the thin film, thereby selectively increasing a polishing rate of the thicker area of the thin film. Thus, an entire surface of a substrate can be polished exactly to a desired level irrespective of a film thickness distribution obtained at a time the thin film is formed. Further, even if a vertically movable member is pressed downwardly for polishing, excessive downward forces are not applied to a substrate which is brought into close contact with the abutment portion, so that a uniform polishing rate can be achieved in an area between the base portions of the flanges. Further, even if a vertically movable member is lifted for polishing, excessive upward forces are not applied to the abutment portion, so that a vacuum is not formed near the base portions of the flanges to achieve a uniform polishing rate in an area between the base portions.

Figure 13:
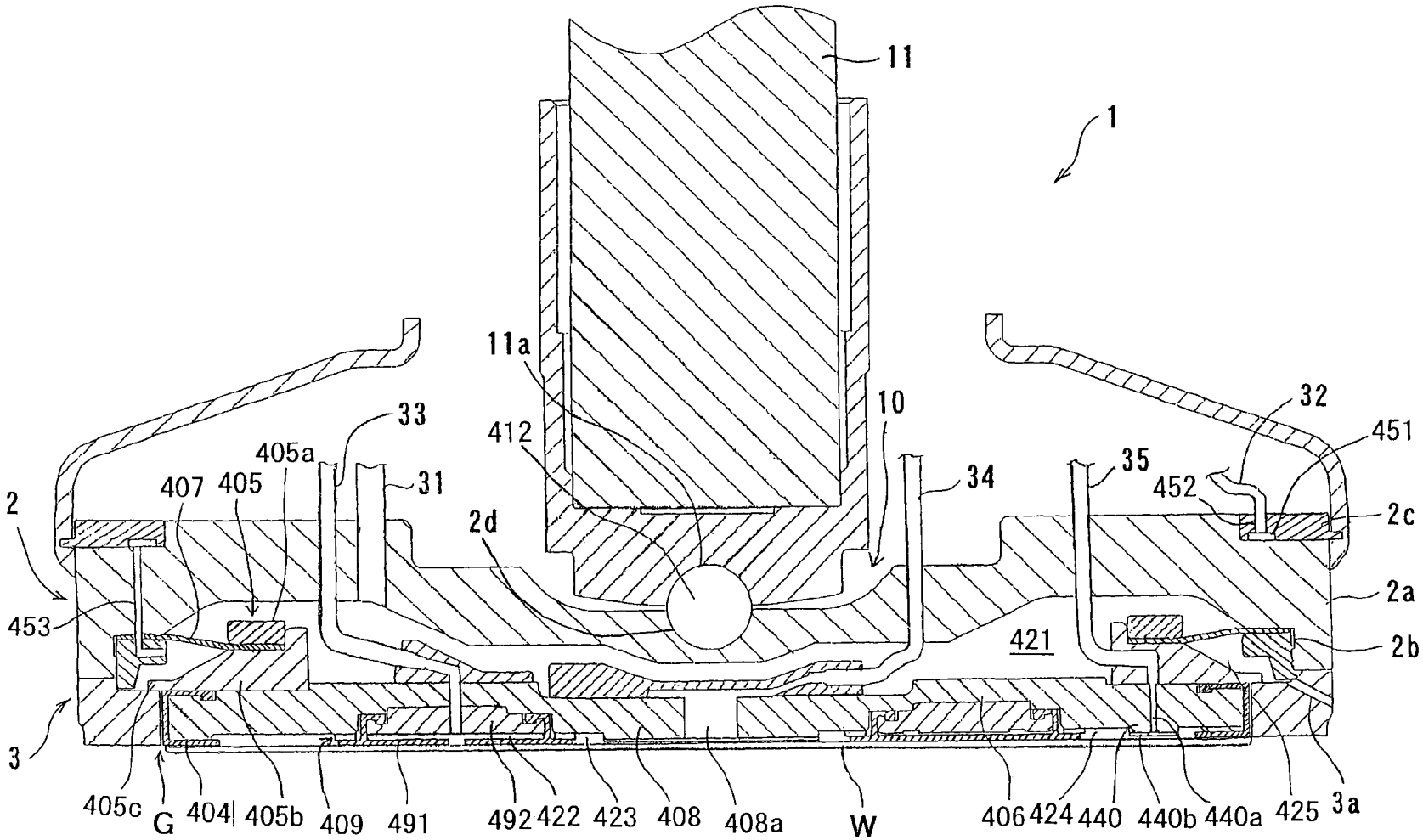
FIG. 13 is a vertical cross-sectional view showing a substrate holding apparatus according to a second embodiment of the present invention.
Figure 14:
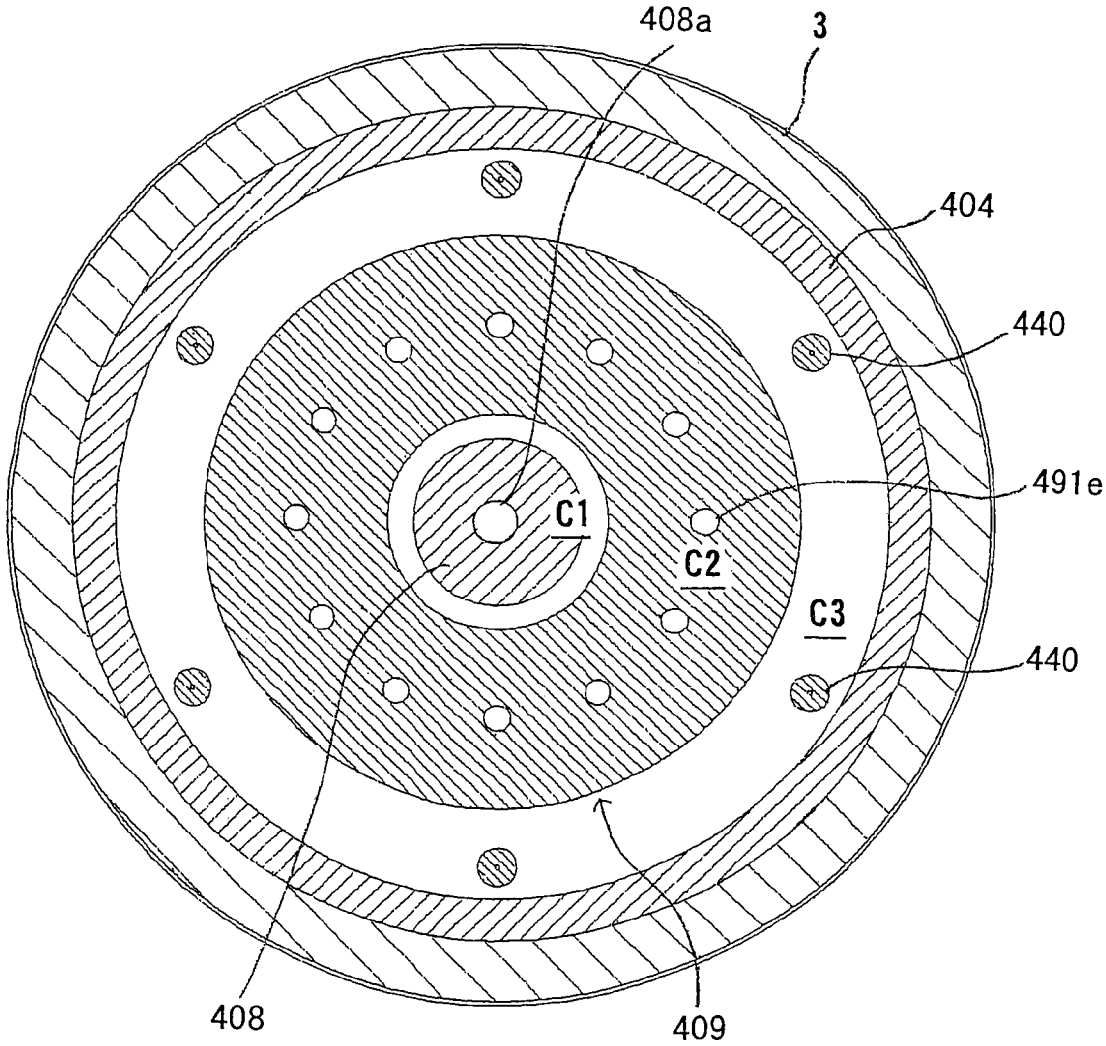
FIG. 14 is a bottom view of the substrate holding apparatus shown in FIG. 13.

Next, a substrate holding apparatus according to a second embodiment of the present invention will be described below. FIG. 13 is a vertical cross-sectional view showing a top ring 1 as a substrate holding apparatus according to the second embodiment of the present invention, and FIG. 14 is a bottom view showing the top ring 1 shown in FIG. 13. As shown in FIG. 13, the top ring 1 constituting a substrate holding apparatus comprises a top ring body 2 in the form of a cylindrical housing with a receiving space defined therein, and a retainer ring 3 fixed to a lower end of the top ring body 2. The top ring body 2 is made of a material having high strength and rigidity, such as metal or ceramic. The retainer ring 3 is made of highly rigid synthetic resin, ceramic, or the like.

The top ring body 2 comprises a cylindrical housing 2*a*, an annular pressurizing sheet support 2*b* fitted into a cylindrical portion of the housing 2*a*, and an annular seal 2*c* fitted over an outer circumferential edge of an upper surface of the housing 2*a*. The retainer ring 3 is fixed to a lower end of the housing 2*a* of the top ring body 2. The retainer ring 3 has a lower portion projecting radially inwardly. The retainer ring 3 may be formed integrally with the top ring body 2.

A top ring drive shaft 11 is disposed above a central portion of the housing 2*a* of the top ring body 2, and the top ring body 2 is coupled to the top ring drive shaft 11 by a universal joint 10. The universal joint 10 has a spherical bearing mechanism by which the top ring body 2 and the top ring drive shaft 11 are tiltable with respect to each other, and a rotation transmitting mechanism for transmitting rotation of the top ring drive shaft 11 to the top ring body 2. The spherical bearing mechanism and the rotation transmitting mechanism transmit a pressing force and a rotating force from the top ring drive shaft 11 to the top ring body 2 while allowing the top ring body 2 and the top ring drive shaft 11 to be tilted with respect to each other.

The spherical bearing mechanism comprises a hemispherical concave recess 11*a* defined centrally in a lower surface of the top ring drive shaft 11, a hemispherical concave recess 2*d* defined centrally in an upper surface of the housing 2*a*, and a ball bearing 12 made of a highly hard material such as ceramic and interposed between the concave recesses 11*a* and 2*d*. On the other hand, the rotation transmitting mechanism comprises drive pins (not shown) fixed to the top ring drive shaft 11, and driven pins (not shown) fixed to the housing 2*a*. Even if the top ring body 2 is tilted with respect to the top ring drive shaft 11, the drive pins and the driven pins remain in engagement with each other while contact points are displaced because the drive pins and the driven pins are vertically movable relatively to each other. Thus, the rotation transmitting mechanism reliably transmits rotational torque of the top ring drive shaft 11 to the top ring body 2.

The top ring body 2 and the retainer ring 3 secured to the top ring body 2 have a space defined therein, which accommodates therein a seal ring 404 having a lower surface brought into contact with a peripheral portion of a semiconductor wafer W held by the top ring 1, an annular holder ring 405, and a disk-shaped chucking plate 406 (vertically movable member) which is vertically movable within the receiving space in the top ring body 2.

The seal ring 404 has a radially outer edge clamped between the holder ring 405 and the chucking plate 406 secured to a lower end of the holder ring 405 and extends radially inwardly so as to cover a lower surface of the chucking plate 406 near its outer circumferential edge. A lower end surface of the seal ring 404 is brought into contact with an upper surface of semiconductor wafer W to be polished. The seal ring 404 is made of a highly strong and durable rubber material such as ethylene propylene rubber (EPDM), polyurethane rubber, or silicone rubber. The semiconductor wafer W has a recess defined in an outer edge thereof, which is referred to as a notch or orientation flat, for recognizing (identifying) an orientation of the semiconductor wafer. The seal ring 404 should preferably extend radially inwardly of the chucking plate 406 from an innermost position of such a notch or orientation flat.

A pressurizing sheet 407 comprising an elastic membrane extends between the holder ring 405 and the top ring body 2. The pressurizing sheet 407 has a radially outer edge clamped between the housing 2*a* and the pressurizing sheet support 2*b* of the top ring body 2, and a radially inner edge clamped between an upper end portion 405*a* and a stopper 405*b* of the holder ring 405. The top ring body 2, the chucking plate 406, the holder ring 405, and the pressurizing sheet 407 jointly define a pressure chamber 421 in the top ring body 2. As shown in FIG. 13, a fluid passage 31 comprising tubes and connectors communicates with the pressure chamber 421, which is connected to a compressed air source 120 via a regulator R2 provided on the fluid passage 31 (see FIG. 1). The pressurizing sheet 407 is made of a highly strong and durable rubber material such as ethylene propylene rubber (EPDM), polyurethane rubber, or silicone rubber.

In a case where the pressurizing sheet 407 is made of an elastic material such as rubber, if the pressurizing sheet 407 is fixedly clamped between the retainer ring 3 and the top ring body 2, then a desired horizontal surface cannot be maintained on a lower surface of the retainer ring 3 because of elastic deformation of the pressurizing sheet 407 as an elastic material. In order to prevent such a drawback, the pressurizing sheet 407 is clamped between the housing 2*a* of the top ring body 2 and the pressurizing sheet support 2*b* provided as a separate member in the present embodiment. The retainer ring 3 may vertically be movable with respect to the top ring body 2, or the retainer ring 3 may have a structure capable of pressing the polishing surface independently of the top ring body 2. In such cases, the pressurizing sheet 407 is not necessarily fixed in the aforementioned manner.

A cleaning liquid passage 451 in the form of an annular groove is defined in an upper surface of the housing 2*a* near its outer circumferential edge over which the seal 2*c* of the top ring body 2 is fitted. The cleaning liquid passage 451 communicates with a fluid passage 32 via a through-hole 452, and is supplied with a cleaning liquid (pure water) via the fluid passage 32. A plurality of communication holes 453 is defined in the housing 2*a* and the pressurizing sheet support 2*b* in communication with the cleaning liquid passage 451. The communication holes 453 communicate with a small gap G defined between an outer circumferential surface of the seal ring 404 and an inner circumferential surface of the retainer ring 3.

The chucking plate 406 has a central port 408 provided on a lower surface of a central portion of the chucking plate 406, with an opening 408*a* defined at a central portion of the central port 408. A ring tube 409 which serves as an abutment member brought into contact with the semiconductor wafer W is mounted in a space defined between the chucking plate 406 and the semiconductor wafer W. In the present embodiment, as shown in FIGS. 13 and 14, the ring tube 409 is disposed radially outwardly of the central port 408 in a surrounding relation relative thereto. The chucking plate 406 has suction portions 440 extended downwardly therefrom outside of the ring tube 409. In the present embodiment, six suction portions 440 are provided.

The ring tube 409 comprises an elastic membrane 491 brought into contact with an upper surface of the semiconductor wafer W, and a ring tube holder 492 for detachably holding the elastic membrane 491 in position. The ring tube 409 has a pressure chamber 422 defined therein by the elastic membrane 491 and the ring tube holder 492. A space defined between the chucking plate 406 and the semiconductor wafer W is divided into a plurality of spaces by the ring tube 409. Accordingly, a pressure chamber 423 is defined radially inwardly of the ring tube 409, i.e., around the central port 408, and a pressure chamber 424 is defined radially outwardly of the ring tube 409, i.e., around the suction portions 440. The elastic membrane 491 of the ring tube 409 is made of a highly strong and durable rubber material such as ethylene propylene rubber (EPDM), polyurethane rubber, or silicone rubber, as with the pressurizing sheet 407.

A fluid passage 33 comprising tubes and connectors communicates with the pressure chamber 422 in the ring tube 409. The pressure chamber 422 is connected to the compressed air source 120 via a regulator R3 connected to the fluid passage 33. A fluid passage 34 comprising tubes and connectors communicates with the opening 408*a* of the central port 408. The central port 408 is connected to the compressed air source 120 via a regulator R4 connected to the fluid passage 34. Each suction portion 440 has a communication hole 440*a* communicating with a fluid passage 35 comprising tubes and connectors. The suction portions 440 are connected to the compressed air source 120 via a regulator R5 connected to the fluid passages 35. The compressed air source 120 develops a negative pressure at opening ends of communication holes 440*a* of the suction portions 440 to attract a semiconductor wafer W to the suction portions 440. The suction portions 440 have elastic sheets 440*b*, such as thin rubber sheets, attached to their lower ends, for thereby elastically contacting and holding the semiconductor wafer W on lower surfaces thereof. The pressure chambers 421 to 424 are connected to respective regulators R2 to R5 through a rotary joint (not shown) mounted on an upper end of the top ring shaft 110.

The pressure chamber 421 above the chucking plate 406 and the pressure chambers 422, 423, 424 are supplied with pressurized fluids such as pressurized air or atmospheric air or evacuated, via the fluid passages 31, 33, 34 and 35 connected to respective pressure chambers. As shown in FIG. 1, the regulators R2 to R5 connected to the fluid passages 31, 33, 34 and 35 of the pressure chambers 421 to 424 can respectively regulate pressures of the pressurized fluids supplied to the respective pressure chambers. Thus, it is possible to independently control pressures in the pressure chambers 421 to 424 or independently introduce atmospheric air or vacuum into the pressure chambers 421 to 424. In this manner, the pressures in the pressure chambers 421 to 424 are independently varied with the regulators R2 to R5, so that pressing forces to press the semiconductor wafer W against polishing pad 101 can be adjusted in local areas of the semiconductor wafer W.

In this case, pressurized fluid or atmospheric air supplied to the pressure chambers 422 to 424 may independently be controlled in terms of temperature. With this configuration, it is possible to directly control temperature of a workpiece such as a semiconductor wafer from a backside of the surface to be polished. Particularly, when each of the pressure chambers is independently controlled in terms of temperature, a rate of chemical reaction can be controlled during chemical polishing process of CMP.

Since there is a small gap G between the outer circumferential surface of the seal ring 404 and the inner circumferential surface of the retainer ring 3, the holder ring 405, the chucking plate 406, and the seal ring 404 attached to the chucking plate 406 can vertically be moved with respect to the top ring body 2 and the retainer ring 3, and hence are of a floating structure with respect to the top ring body 2 and the retainer ring 3. The stopper 405*b* of the holder ring 405 has a plurality of teeth 405*c* projecting radially outwardly from an outer circumferential edge thereof. Downward movement of members including the holder ring 405 is limited to a predetermined range by engaging the teeth 405*c* with an upper surface of a radially inwardly projecting portion of the retainer ring 3.

For example, in a case where the chucking plate is made of PPS (polyphenylene sulfide), if pressure in the pressure chamber 421 is higher than pressures in the pressure chambers 422 to 424 below the chucking plate 406, the chucking plate is bent so that the suction portions 440 press the semiconductor wafer W to increase polishing rates at those local areas. Accordingly, the chucking plate 406 in the present embodiment is made of a material having a larger stiffness and a lighter weight than that of PPS, e.g., epoxy resin, preferably a fiber reinforced material such as a glass fiber reinforced material. Thus, with the chucking plate 406 made of a material having a large stiffness, even if the pressure in the pressure chamber 421 is higher than the pressures in the pressure chambers 422 to 424 below the chucking plate 406, the chucking plate 406 becomes unlikely to be bent, so that polishing rates are prevented from being locally increased. Particularly, since epoxy resin has no magnetism, it is suitable for cases where a film thickness of a thin film formed on a surface of a semiconductor wafer to be polished is measured with a film thickness method using eddy current in such a state that the semiconductor wafer is held by a top ring. The material is not limited to epoxy resin, and it is also effective to use other resin having a large stiffness, fiber reinforced materials thereof, or ceramics.

Next, operation of the top ring 1 thus constructed will be described in detail below.

In the polishing apparatus constructed above, when a semiconductor wafer W is to be delivered to the polishing apparatus, the top ring 1 as a whole is moved to a position to which the semiconductor wafer W is transferred, and the communication holes 440*a* of the suction portions 440 are connected via the fluid passage 35 to the vacuum source 121. The semiconductor wafer W is attracted under vacuum to lower ends of the suction portions 440 by suction effect of the communication holes 440*a*. With the semiconductor wafer W attracted to the top ring 1, the top ring 1 as a whole is moved to a position above the polishing table 100 having a polishing surface (polishing pad 101) thereon. An outer circumferential edge of the semiconductor wafer W is held by the retainer ring 3 so that the semiconductor wafer W is not removed from the top ring 1.

For polishing the semiconductor wafer W, attraction of semiconductor wafer W by the suction portions 440 is released, and the semiconductor wafer W is held on a lower surface of the top ring 1. Simultaneously, top ring air cylinder 111 connected to the top ring drive shaft 11 is actuated to press the retainer ring 3 fixed to the lower end of the top ring 1 against the polishing surface on the polishing table 100 under a predetermined pressure (see FIG. 1). In such a state, pressurized fluids are respectively supplied to the pressure chambers 422, 423, 424 under respective pressures, thereby pressing the semiconductor wafer W against the polishing surface on the polishing table 100. Polishing liquid supply nozzle 102 supplies a polishing liquid Q onto the polishing pad 101 in advance, so that the polishing liquid Q is held on the polishing pad 101. Thus, the semiconductor wafer W is polished by the polishing pad 101 with the polishing liquid Q being present between a (lower) surface, to be polished, of the semiconductor wafer W and the polishing pad 101.

Local areas of the semiconductor wafer W that are positioned beneath the pressure chambers 423, 424 are pressed against the polishing surface under pressures of the pressurized fluids supplied to the pressure chambers 423, 424. A local area of the semiconductor wafer W that is positioned beneath the central pressure chamber 422 is pressed via the elastic membrane 491 of the ring tube 409 against the polishing surface under pressure of the pressurized fluid supplied to the pressure chamber 422. Therefore, polishing pressures acting on respective local areas of the semiconductor wafer W can be adjusted independently by controlling pressures of the pressurized fluids supplied to the respective pressure chambers 422 to 424. Specifically, the respective regulators R3 to R5 independently regulate the pressures of the pressurized fluids supplied to the pressure chambers 422 to 424 for thereby adjusting the pressing forces applied to press the local areas of the semiconductor wafer W against the polishing pad 101 on the polishing table 100. With the polishing pressures on the respective local areas of the semiconductor wafer W being adjusted independently to desired values, the semiconductor wafer W is pressed against the polishing pad 101 on the polishing table 100 that is being rotated. Similarly, pressure of the pressurized fluid supplied to the top ring air cylinder 111 can be regulated by the regulator R1 to adjust a force with which the retainer ring 3 presses the polishing pad 101. While the semiconductor wafer W is being polished, the force with which the retainer ring 3 presses the polishing pad 101 and the pressing force with which the semiconductor wafer W is pressed against the polishing pad 101 can appropriately be adjusted for thereby applying polishing pressures in a desired pressure distribution to a central area (C1 in FIG. 14), an intermediate area (C2), a peripheral area (C3), and a peripheral portion of the retainer ring 3 which is positioned outside of the semiconductor wafer W.

In this manner, the semiconductor wafer W is divided into three concentric circular and annular areas (C1 to C3), which can respectively be pressed under independent pressing forces. A polishing rate depends on a pressing force applied to a semiconductor wafer W against a polishing surface. As described above, since the pressing forces applied to those areas can independently be controlled, polishing rates of the three circular and annular areas (C1 to C3) of the semiconductor wafer W can independently be controlled. Consequently, even if a thickness of a thin film to be polished on a surface of the semiconductor wafer W suffers radial variations, the thin film on the surface of the semiconductor wafer W can be polished uniformly without being insufficiently or excessively polished over an entire surface of the semiconductor wafer. More specifically, even if the thickness of the thin film to be polished on the surface of the semiconductor wafer W differs depending on a radial position on the semiconductor wafer W, pressure in a pressure chamber positioned over a thicker area of the thin film is made higher than pressure in other pressure chambers, or pressure in a pressure chamber positioned over a thinner area of the thin film is made lower than pressure in other pressure chambers. In this manner, a pressing force applied to the thicker area of the thin film against the polishing surface is made higher than a pressing force applied to the thinner area of the thin film against the polishing surface, thereby selectively increasing a polishing rate of the thicker area of the thin film. Consequently, an entire surface of the semiconductor wafer W can be polished exactly to a desired level over the entire surface of the semiconductor wafer W irrespective of a film thickness distribution produced at a time the thin film is formed.

Any unwanted edge rounding on a circumferential edge of the semiconductor wafer W can be prevented by controlling the pressing force applied to the retainer ring 3. If the thin film to be polished on the circumferential edge of the semiconductor wafer W has large thickness variations, then the pressing force applied to the retainer ring 3 is intentionally increased or reduced to thus control a polishing rate of the circumferential edge of the semiconductor wafer W. When pressurized fluids are supplied to the pressure chambers 422 to 424, the chucking plate 406 is subjected to upward forces. In the present embodiment, the pressurized fluid is supplied to the pressure chamber 421 via the fluid passage 31 to prevent the chucking plate 406 from being lifted under forces due to the pressure chambers 422 to 424.

As described above, the pressing force applied by the top ring air cylinder 111 to press the retainer ring 3 against the polishing pad 101 and the pressing forces applied by the pressurized air supplied to the pressure chambers 422 to 424 to press the local areas of the semiconductor wafer W against the polishing pad 101 are appropriately adjusted to polish the semiconductor wafer W. When polishing of the semiconductor wafer W is finished, the semiconductor wafer W is attracted again to the lower ends of the suction portions 440 under vacuum. At this time, supply of the pressurized fluids into the pressure chambers 422 to 424 to press the semiconductor wafer W against the polishing surface is stopped, and the pressure chambers 422 to 424 are vented to an atmosphere. Accordingly, the lower ends of the suction portions 440 are brought into contact with the semiconductor wafer W. The pressure chamber 421 is vented to the atmosphere or evacuated to develop a negative pressure therein. If the pressure chamber 421 is maintained at a high pressure, then the semiconductor wafer W is strongly pressed against the polishing surface only in areas brought into contact with the suction portions 440.

After attraction of the semiconductor wafer W, the top ring 1 as a whole is moved to a position to which the semiconductor wafer W is to be transferred, and then a fluid (e.g., compressed air or a mixture of nitrogen and pure water) is ejected to the semiconductor wafer W via the communication holes 440*a* of the suction portions 440 to release the semiconductor wafer W from the top ring 1.

The polishing liquid Q used to polish the semiconductor wafer W tends to flow through the small gap G between the outer circumferential surface of the seal ring 404 and the retainer ring 3. If the polishing liquid Q is firmly deposited in the gap G, then the holder ring 405, the chucking plate 406, and the seal ring 404 are prevented from smoothly moving vertically with respect to the top ring body 2 and the retainer ring 3. To avoid such a drawback, a cleaning liquid (pure water) is supplied through the fluid passage 32 to the cleaning liquid passage 451. Accordingly, the pure water is supplied via a plurality of communication holes 453 to a region above the gap G, thus cleaning the gap G to prevent the polishing liquid Q from being firmly deposited in the gap G. The pure water should preferably be supplied after a polished semiconductor wafer W is released and not until a next semiconductor wafer to be polished is attracted to the top ring 1. It is also preferable to discharge all supplied pure water out of the top ring 1 before the next semiconductor wafer is polished, and hence to provide the retainer ring 3 with a plurality of through-holes 3*a* shown in FIG. 13. Furthermore, if a pressure buildup is developed in a space 425 defined between the retainer ring 3, the holder ring 405, and the pressurizing sheet 407, then it acts to prevent the chucking plate 406 from being elevated in the top ring body 2. Therefore, in order to allow the chucking plate 406 to be elevated smoothly in the top ring body 2, the through-holes 3*a* should preferably be provided for equalizing pressure in the space 425 with atmospheric pressure.

As described above, according to a substrate holding apparatus of the second embodiment, pressures in the pressure chambers 422, 423, 424 are independently controlled to control pressing forces acting on the semiconductor wafer W.

The ring tube 409 of the substrate holding apparatus according to the second embodiment of the present invention will be described in detail below.

Figure 15:
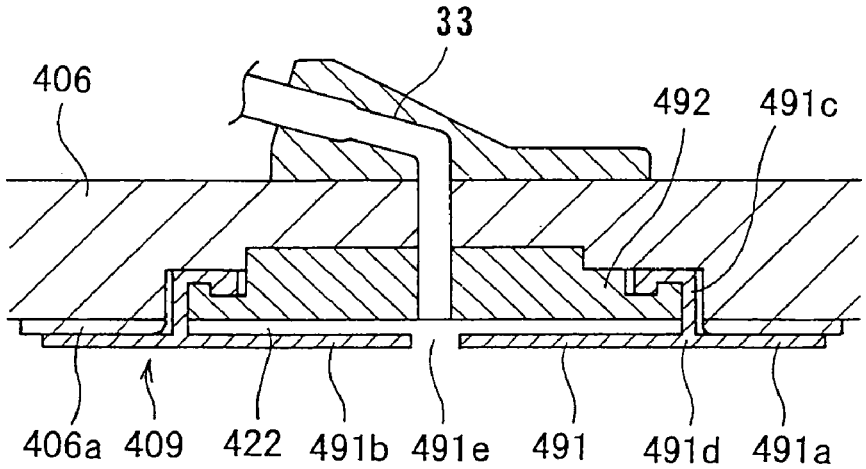
FIG. 15 is a vertical cross-sectional view showing a ring tube in the substrate holding apparatus according to the second embodiment of the present invention.

FIG. 15 is a vertical cross-sectional view showing the ring tube 409 shown in FIG. 13. As shown in FIG. 15, the elastic membrane 491 of the ring tube 409 in the present embodiment has an abutment portion 491*b* having flanges 491*a* projecting outwardly and inwardly, and connecting portions 491*c* connected via the ring tube holder 492 to the chucking plate 406. The connecting portions 491*c* extend upwardly from base portions 491*d* of the flanges 491*a*. A lower surface of the abutment portion 491*b* is brought into contact with the upper surface of the semiconductor wafer W. The flanges 491*a*, the abutment portion 491*b*, and the connecting portions 491*c* are integrally made of the same material.

As described above, when a semiconductor wafer is polished, pressurized fluids are supplied to the pressure chamber 422, and the pressure chambers 423, 424 surrounding the ring tube 409. Thus, the flanges 491*a* are brought into close contact with the semiconductor wafer W by the pressurized fluids supplied to the pressure chambers 423, 424. Accordingly, even if pressure of the pressurized fluid supplied to the pressure chamber 423 or 424 surrounding the pressure chamber 422 is considerably higher than pressure of the pressurized fluid supplied to the pressure chamber 422 defined in the ring tube 409, high-pressure fluid surrounding the pressure chamber 422 is prevented from flowing into a lower portion of the ring tube 409. Therefore, the flanges 491*a* can widen a range of pressure control in each of the pressure chambers, for thereby pressing the semiconductor wafer more stably.

Openings 491*e* are formed at a plurality of central portions of the abutment portion 491*b* of the ring tube 409, and thus a pressurized fluid supplied to the pressure chamber 422 directly contacts with the upper surface of the semiconductor wafer W through the openings 491*e* of the abutment portion 491*b*. Since a pressurized fluid is supplied to the pressure chamber 422 during polishing, the pressurized fluid presses the abutment portion 491*b* of the ring tube 409 against the upper surface of the semiconductor wafer W. Therefore, even if the openings 491*e* are formed in the abutment portion 491*b*, a pressurized fluid in the pressure chamber 422 hardly flows out to an exterior of the pressure chamber 422. Further, when the semiconductor wafer W is released, a downward pressure can be applied through the openings 491*e* to the semiconductor wafer W by a pressurized fluid, so that the semiconductor wafer W can more smoothly be released.

When the pressurized fluid supplied to the intermediate pressure chamber 422 is controlled in terms of temperature and a temperature of the semiconductor wafer W is controlled from the backside of the surface to be polished, as described above, the openings 491*e* formed in the abutment portion 491*b* of the ring tube 409 can increase an area in which the pressurized fluid controlled in terms of temperature is brought into contact with the semiconductor wafer W. Therefore, controllability in terms of temperature of the semiconductor wafer W can be improved. Further, when polishing of the semiconductor wafer W is finished and the semiconductor wafer W is released, the pressure chamber 422 is opened to outside air via the openings 491*e*. Thus, fluid supplied into the pressure chamber 422 is prevented from remaining in the pressure chamber 422. Therefore, even if semiconductor wafers W are continuously polished, controllability in terms of temperature of the semiconductor wafer W can be maintained.

Figure 16:
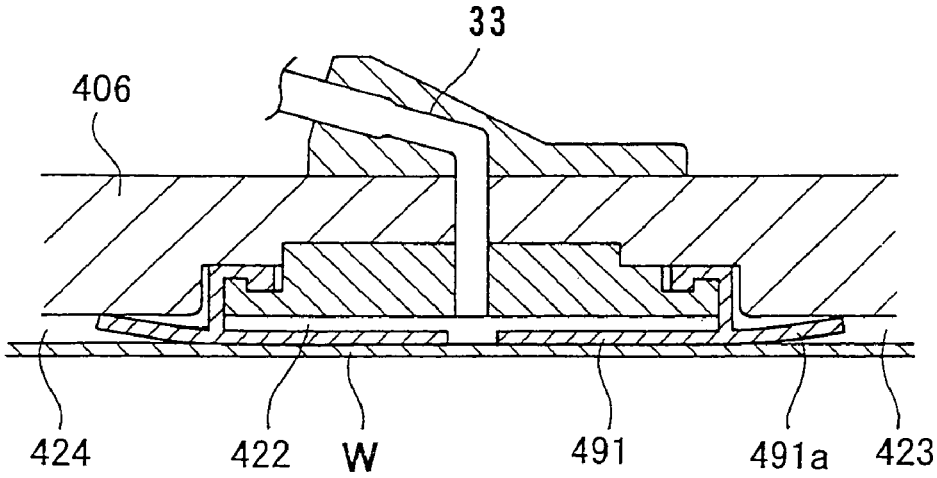
FIG. 16 is a vertical cross-sectional view showing a ring tube without any support portions in a chucking plate.

As shown in FIG. 15, the chucking plate 406 has support portions 406*a* for supporting the flanges 491*a* of the ring tube 409. If the chucking plate 406 has no support portions 406*a*, then the flanges 491*a* may be deformed and attached to a lower surface of the chucking plate 406 as shown in FIG. 16 when pressurized fluids are supplied to the pressure chambers 423, 424 surrounding the ring tube 409. In such a state, it is impossible to properly control pressures of the pressure chambers 422 to 424. Accordingly, in the present embodiment, the support portions 406*a* are provided on the chucking plate 406 for supporting the flanges 491*a* of the ring tube 409, as described above, to prevent the flanges 491*a* from being attached to the lower surface of the chucking plate 406 and to stabilize pressures of the pressure chambers 422 to 424. In this case, when the support portions have radial lengths larger than radial lengths of the flanges 491*a*, it is possible to support the flanges 491*a* more reliably.

Figure 17:
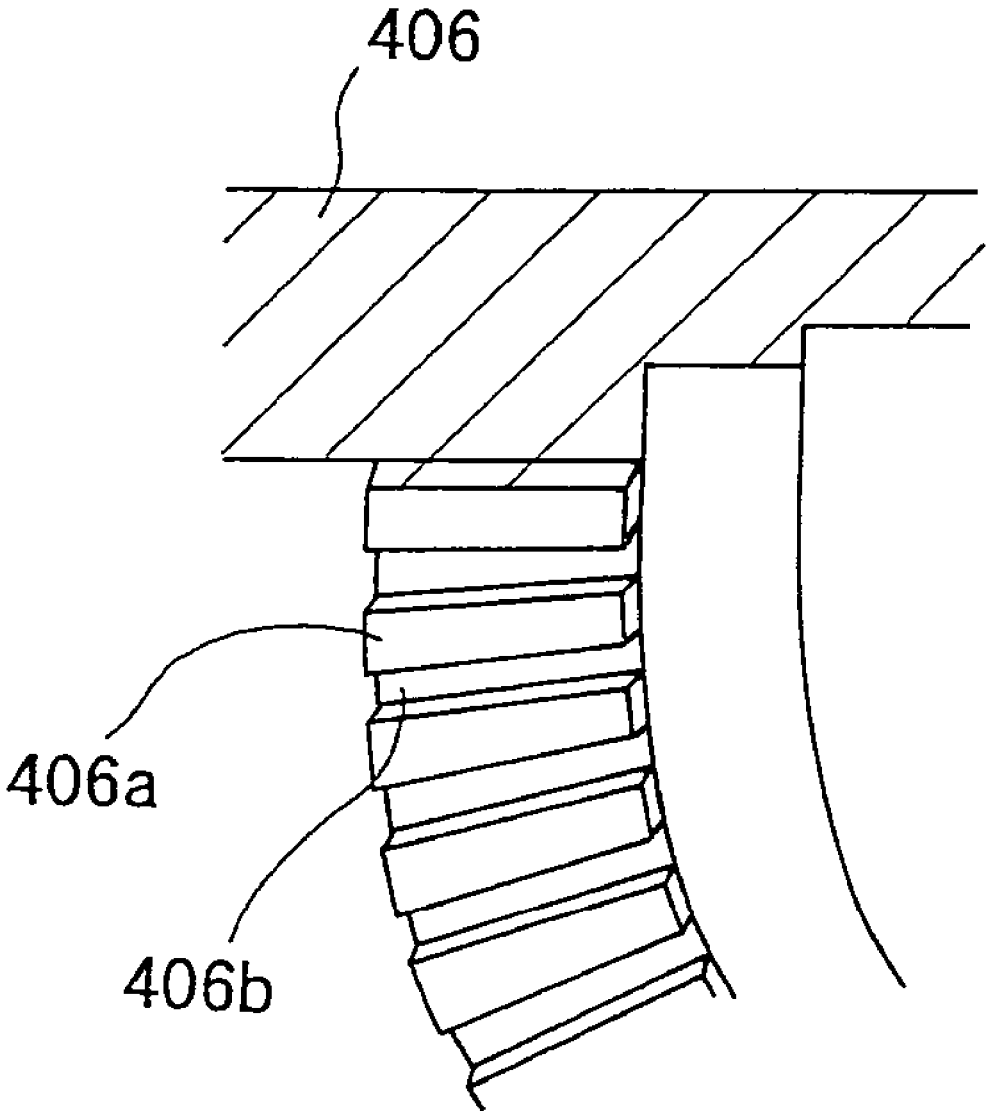
FIG. 17 is a partial perspective view showing a support portion of a chucking plate of FIG. 15.

In this case, the flanges 491*a* of the ring tube 409 are brought into contact with the support portions 406*a* of the chucking plate 406. In order to enhance adhesiveness of the flanges 491*a* to the semiconductor wafer W, it is necessary to press the flanges 491*a* by pressurized fluids supplied to the pressure chambers 423, 424. Accordingly, in the present embodiment, as shown in FIG. 17, fluid introduction grooves 406*b* are formed in the support portions 406*a* of the chucking plate 406 for stably pressing the flanges 491*a* by pressurized fluids supplied to the pressure chambers 423, 424 to enhance adhesiveness between the flanges 491*a* and the semiconductor wafer W.

Figure 18:
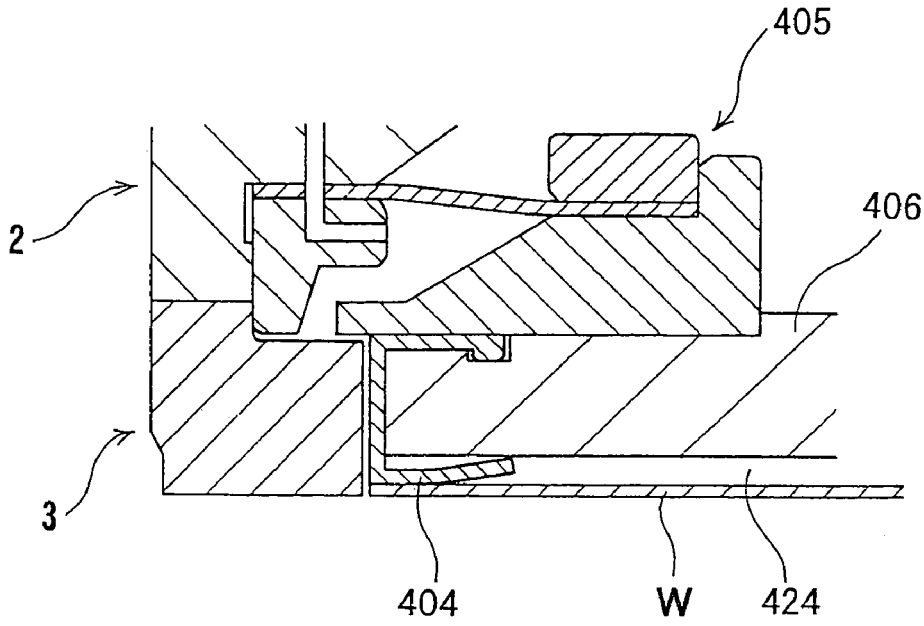
FIG. 18 is a vertical cross-sectional view showing a seal ring without any support portions in a chucking plate.
Figure 19:
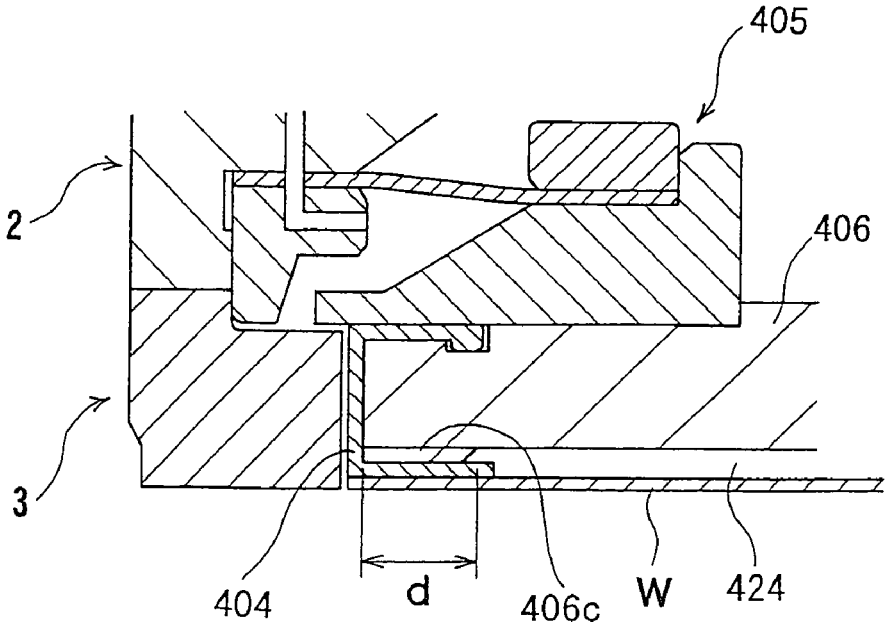
FIG. 19 is a vertical cross-sectional view showing a seal ring in the substrate holding apparatus of FIG. 15.

Similarly, with respect to the seal ring 404, the seal ring 404 may be attached to a peripheral portion of the chucking plate 406 by a pressurized fluid supplied to the pressure chamber 424, as shown in FIG. 18. Accordingly, in the present embodiment, a support portion 406*c* is provided at a peripheral portion of the chucking plate 406 for supporting the seal ring 404, as shown in FIG. 19. In this case, as with the support portions 406*a*, fluid introduction grooves may be formed in the support portion 406*c* for stably pressing the seal ring 404 by a pressurized fluid supplied to the pressure chamber 424 to enhance adhesiveness between the seal ring 404 and the semiconductor wafer W. Further, since such grooves can introduce pressurized fluid to an outermost portion of a semiconductor wafer, a uniform pressing force can be achieved at a peripheral portion of the wafer.

When the retainer ring 3 is pressed against the polishing pad 101, the polishing pad 101 may be raised (rebounded) near the retainer ring 3 so that a polishing rate is locally increased at the peripheral portion of semiconductor wafer W. In the present embodiment, a radial length d of the support portion 406*c* of the chucking plate 406 is shortened to prevent the semiconductor wafer W from being excessively polished at the peripheral portion thereof. When effects of rebound are small, the length d is shortened to concentrate pressing forces, or the length d is lengthened to disperse the pressing forces, for varying polishing rates. Specifically, the length d is varied in a range of 1 mm to 7 mm to achieve desired polishing rates.

In the substrate holding apparatus according to the second embodiment described above, the fluid passages 31, 33, 34 and 35 are provided as separate passages. However, these fluid passages may be combined with each other, or the pressure chambers may be communicated with each other in accordance with a magnitude of a pressing force to be applied to the semiconductor wafer W and a position to which the pressing force is applied. In the above embodiment, the ring tube 409 is brought into direct contact with the semiconductor wafer W. However, the present invention is not limited to such a configuration. For example, an elastic pad may be interposed between the ring tube 409 and the semiconductor wafer W so that the ring tube 409 is brought into indirect contact with the semiconductor wafer W.

In the second embodiment shown in FIGS. 13 through 19, the polishing surface is constituted by the polishing pad. However, the polishing surface is not limited to this. The polishing surface may be constituted by a fixed abrasive as described in the first embodiment shown in FIGS. 2 through 12.

As described above, according to the substrate holding apparatus of the second embodiment of the present invention, pressures to be applied to a substrate can independently be controlled, and hence a pressing force applied to a thicker area of a thin film can be made higher than a pressing force applied to a thinner area of the thin film, thereby selectively increasing a polishing rate of the thicker area of the thin film. Thus, an entire surface of a substrate can be polished exactly to a desired level irrespective of a film thickness distribution obtained at a time the thin film is formed. Further, with a vertically movable member made of a material having a large stiffness and a light weight, e.g., epoxy resin, the vertically movable member becomes unlikely to be bent, so that polishing rates are prevented from being locally increased. Further, when a material having no magnetism is selected as a material of the vertically movable member, it is suitable for cases where a film thickness of a thin film formed on a surface of a semiconductor wafer to be polished is measured with a film thickness method using eddy current in such a state that the semiconductor wafer is held by a top ring.

Figure 20:
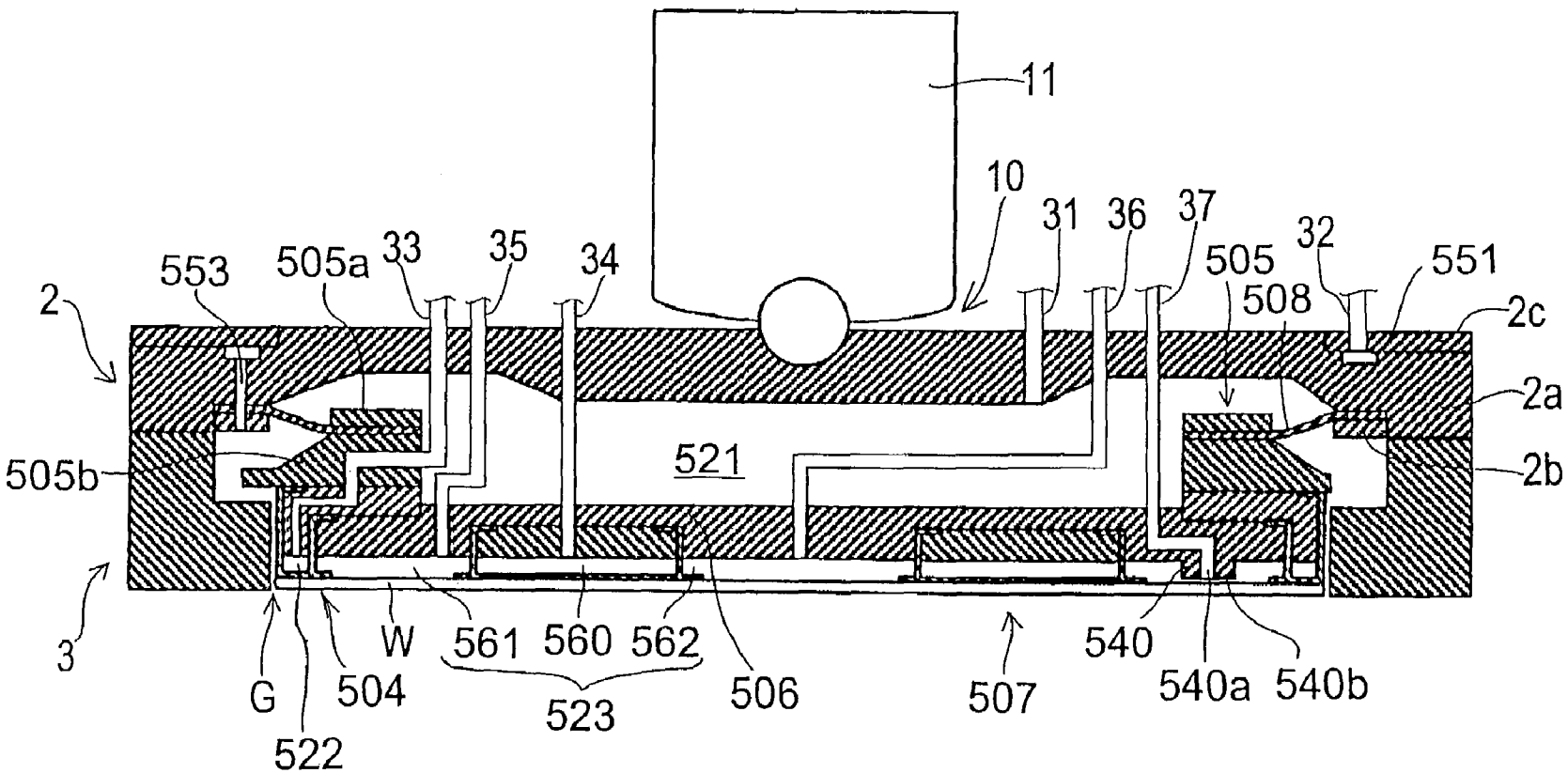
FIG. 20 is a vertical cross-sectional view showing a substrate holding apparatus according to a third embodiment of the present invention.

Next, a substrate holding apparatus according to a third embodiment of the present invention will be described below. FIG. 20 is a vertical cross-sectional view showing a top ring 1 according to the third embodiment of the present invention. As shown in FIG. 20, the top ring 1 constituting a substrate holding apparatus comprises a top ring body 2 in the form of a cylindrical housing with a receiving space defined therein, and a retainer ring 3 fixed to a lower end of the top ring body 2. The top ring body 2 is made of a material having high strength and rigidity, such as metal or ceramic. The retainer ring 3 is made of highly rigid synthetic resin, ceramic, or the like.

The top ring body 2 comprises a cylindrical housing 2*a*, an annular pressurizing sheet support 2*b* fitted into a cylindrical portion of the housing 2*a*, and an annular seal 2*c* fitted over an outer circumferential edge of an upper surface of the housing 2*a*. The retainer ring 3 is fixed to a lower end of the housing 2*a* of the top ring body 2. The retainer ring 3 has a lower portion projecting radially inwardly. The retainer ring 3 may be formed integrally with the top ring body 2.

A top ring drive shaft 11 is disposed above a central portion of the housing 2*a* of the top ring body 2, and the top ring body 2 is coupled to the top ring drive shaft 11 by a universal joint 10. The universal joint 10 has a spherical bearing mechanism by which the top ring body 2 and the top ring drive shaft 11 are tiltable with respect to each other, and a rotation transmitting mechanism for transmitting rotation of the top ring drive shaft 11 to the top ring body 2. The spherical bearing mechanism and the rotation transmitting mechanism transmit a pressing force and a rotating force from the top ring drive shaft 11 to the top ring body 2 while allowing the top ring body 2 and the top ring drive shaft 11 to be tilted with respect to each other.

The top ring body 2 and the retainer ring 3 secured to the top ring body 2 have a space defined therein, which accommodates therein an edge bag 504 having a lower surface brought into contact with a peripheral portion of a semiconductor wafer W held by the top ring 1, a holder ring 505, a disk-shaped chucking plate 506 which is vertically movable within the receiving space in the top ring body 2, and a torque transmitting member 507 having a lower surface brought into contact with the semiconductor wafer W at a radially inward position of the edge bag 504.

The chucking plate 506 may be made of metal. However, when a thickness of a thin film formed on a surface of a semiconductor wafer to be polished is measured by a method using eddy current in such a state that the semiconductor wafer is held by the top ring, the chucking plate 506 should preferably be made of a non-magnetic material, e.g., an insulating material such as fluororesin or ceramic.

A pressurizing sheet 508 comprising an elastic membrane extends between the holder ring 505 and the top ring body 2. The pressurizing sheet 508 has a radially outer edge clamped between the housing 2*a* and the pressurizing sheet support 2*b* of the top ring body 2, and a radially inner edge clamped between an upper end portion 505*a* and a stopper 505*b* of the holder ring 505. The top ring body 2, the chucking plate 506, the holder ring 505, and the pressurizing sheet 508 jointly define a pressure chamber 521 in the top ring body 2. As shown in FIG. 20, a fluid passage 31 comprising tubes and connectors communicates with the pressure chamber 521, which is connected to a compressed air source 120 via a regulator R2 provided on the fluid passage 31 (see FIG. 1). The pressurizing sheet 508 is made of a highly strong and durable rubber material such as ethylene propylene rubber (EPDM), polyurethane rubber, or silicone rubber.

A cleaning liquid passage 551 in the form of an annular groove is defined in an upper surface of the housing 2*a* near its outer circumferential edge over which the seal 2*c* of the top ring body 2 is fitted. The cleaning liquid passage 551 communicates with a fluid passage 32 via a through-hole formed in the seal 2*c*, and is supplied with a cleaning liquid (pure water) via the fluid passage 32. A plurality of communication holes 553 are defined in the housing 2*a* and the pressurizing sheet support 2*b* in communication with the cleaning liquid passage 551. The communication holes 553 communicate with a small gap G defined between an outer circumferential surface of the edge bag 504 and an inner circumferential surface of the retainer ring 3.

Figure 21:
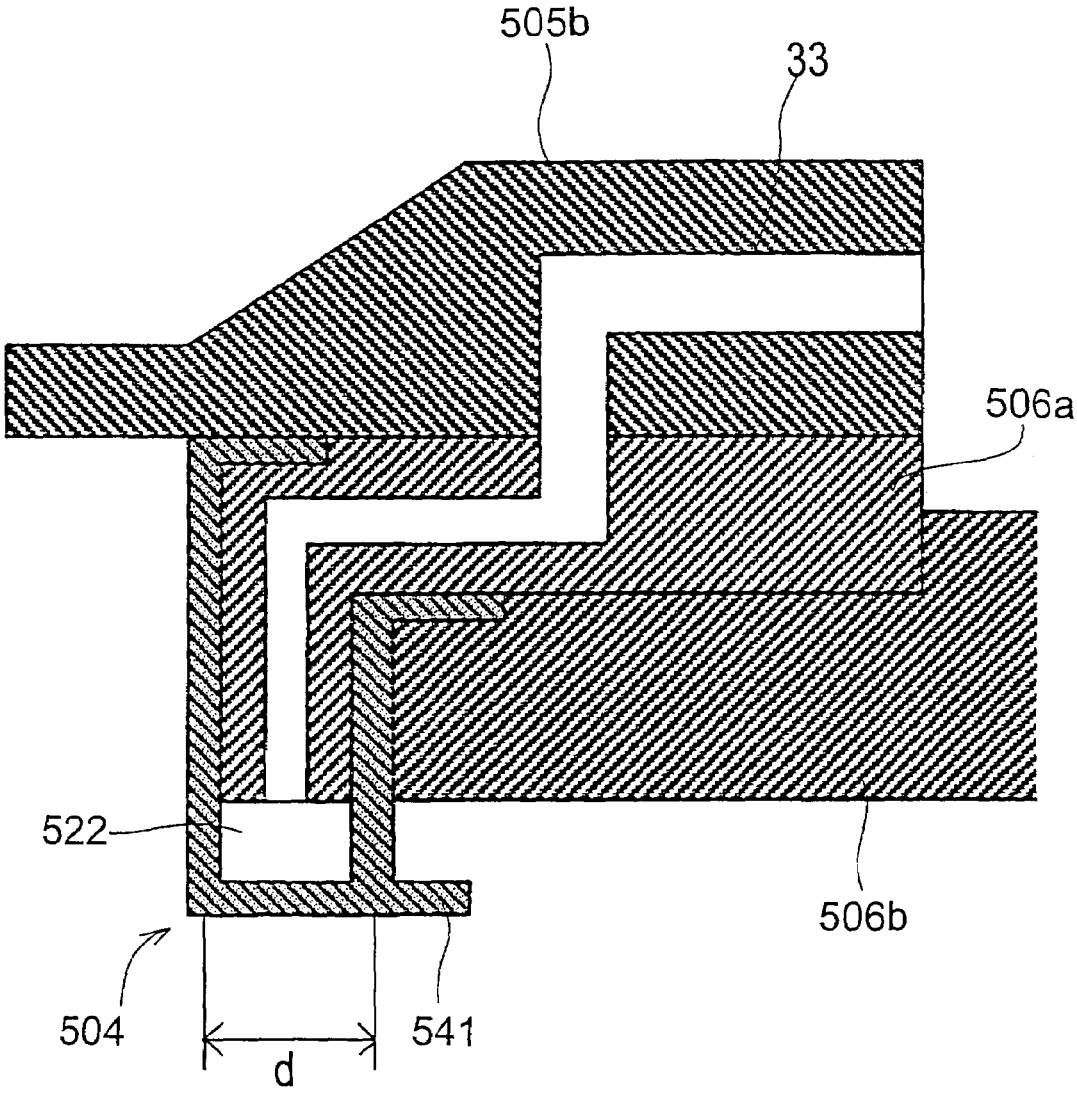
FIG. 21 is a partial cross-sectional view showing an edge bag of FIG. 20.

FIG. 21 is a partial cross-sectional view showing the edge bag 504 of FIG. 20. As shown in FIG. 21, the edge bag 504 has a radially outer edge clamped between the stopper 505*b* of the holder ring 505 and an edge bag holder 506*a* disposed below the holder ring 505, and a radially inner edge clamped between the edge bag holder 506*a* and a chucking plate body 506*b*. A lower end surface of the edge bag 504 is brought into contact with a peripheral portion of the semiconductor wafer W to be polished. The edge bag 504 comprises an elastic membrane made of a highly strong and durable rubber material such as ethylene propylene rubber (EPDM), polyurethane rubber, or silicone rubber.

A lower surface of the edge bag 504 is brought into contact with the peripheral portion of the semiconductor wafer W and provided with a flange 541 projecting radially inwardly. The edge bag 504 has a (first) pressure chamber 522 defined therein by the elastic membrane. A fluid passage 33 comprising tubes and connectors communicates with the pressure chamber 522. The pressure chamber 522 is connected to the compressed air source 120 via a regulator R3 connected to the fluid passages 33.

Upon polishing, semiconductor wafer W is rotated in accordance with rotation of the top ring 1. Since the aforementioned edge bag 504 has a small contact area with the semiconductor wafer W, rotational torque may fail to completely be transmitted to the semiconductor wafer W. Accordingly, the torque transmitting member 507 is secured to the chucking plate 506 for transmitting sufficient torque to the semiconductor wafer W by abutment with the semiconductor wafer W. The torque transmitting member 507 is in the form of an annular bag and is brought into contact with the semiconductor wafer W with a contact area large enough to transmit sufficient torque to the semiconductor wafer W.

Figure 22:
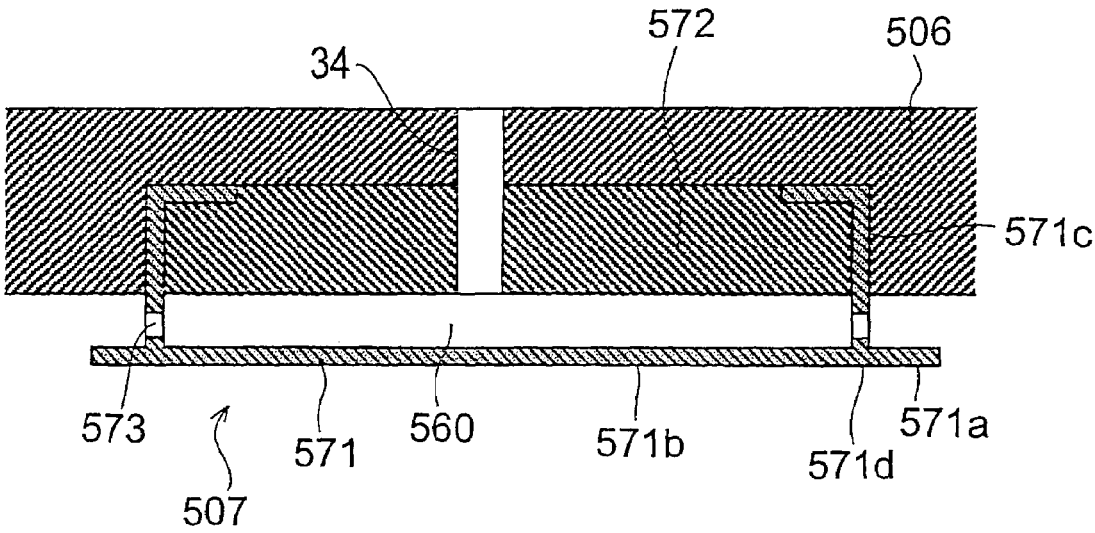
FIG. 22 is a partial cross-sectional view showing a torque transmitting member of FIG. 20.

FIG. 22 is a partial cross-sectional view showing the torque transmitting member 507 of FIG. 20. As shown in FIG. 22, the torque transmitting member 507 comprises an elastic membrane 571 brought into contact with the upper surface of the semiconductor wafer W, and a torque transmitting member holder 572 for detachably holding the elastic membrane 571 in position. The torque transmitting member 507 has a space 560 defined therein by the elastic membrane 571 and the torque transmitting member holder 572. The elastic membrane 571 of the torque transmitting member 507 is made of a highly strong and durable rubber material such as ethylene propylene rubber (EPDM), polyurethane rubber, or silicone rubber, as with the edge bag 504.

As shown in FIG. 22, the elastic membrane 571 of the torque transmitting member 507 has an abutment portion 571*b* having flanges 571*a* projecting outwardly and inwardly, and connecting portions 571*c* connected via the torque transmitting member holder 572 to the chucking plate 506. Two connecting portions 571*c* extend upwardly from base portions 571*d* of the flanges 571*a*. A lower surface of the abutment portion 571*b* is brought into contact with an upper surface of the semiconductor wafer W. The connecting portions 571*c* have a plurality of communication holes 573 provided at radially inward and outward positions, and an interior of internal space 560 of the torque transmitting member 507 is communicated with external spaces 561, 562.

When the two connecting portions 571*c* extending vertically are arranged at relatively near positions, the connecting portions 571*c* have sufficient strength to transmit torque. With the flanges 571*a*, it is possible to maintain a contact area with the semiconductor wafer W.

The space defined between the chucking plate 506 and the semiconductor wafer W is divided into a plurality of spaces, i.e., a pressure chamber 522 disposed radially inwardly of the edge bag 504, the space 560 in the torque transmitting member 507, a space 561 between the edge bag 504 and the torque transmitting member 507, and a space 562 disposed radially inwardly of the torque transmitting member 507. As described above, the communication holes 573 are provided in the connecting portions 571*c* of the torque transmitting member 507. Accordingly, the space 561, the space 560, and the space 562 are communicated with each other through the communication holes 573, so that a (second) pressure chamber 523 is formed radially inwardly of the edge bag 504.

A fluid passage 34 comprising tubes and connectors communicates with the space 560 in the torque transmitting member 507. The space 560 is connected to the compressed air source 120 via a regulator R4 connected to the fluid passage 34. A fluid passage 35 comprising tubes and connectors communicates with the space 561 between the edge bag 504 and the torque transmitting member 507. The space 561 is connected to the compressed air source 120 via a regulator R5 connected to the fluid passage 35. A fluid passage 36 comprising tubes and connectors communicates with the space 562 disposed radially inwardly of the torque transmitting member 507. The space 562 is connected to the compressed air source 120 via a regulator (not shown) connected to the fluid passage 36. The pressure chambers 521 to 523 are connected to respective regulators through a rotary joint (not shown) mounted on an upper end of top ring shaft 110.

Since the space 561, the space 560, and the space 562 are communicated with each other, as described above, one fluid passage can supply a pressurized fluid so as to uniformly control pressure of the pressure chamber 523 without a plurality of fluid passages. However, in order to obtain good responsiveness when pressure of the pressure chamber 523 is varied, it is desirable to provide a plurality of fluid passages 34, 35, 36 as described in the third embodiment. It is not necessary to provide regulators for respective fluid passages 34, 35, 36, and the fluid passages 34, 35, 36 may be connected to one regulator to control pressure.

When the semiconductor wafer is polished, pressurized fluids are supplied to the pressure chamber 522 and the pressure chamber 523, respectively. The flange 541 is provided at a lower end surface of the edge bag 504. The flange 541 is brought into close contact with the semiconductor wafer W by the pressurized fluid supplied to the pressure chamber 523. Accordingly, the pressurized fluid in the pressure chamber 523 is prevented from flowing into a lower portion of the edge bag 504. Therefore, the flange 541 can realize a stable control when pressures of the pressure chamber 522 and the pressure chamber 523 are varied. Here, a radial width d of the elastic membrane defining the pressure chamber 522 in the edge bag 504 should preferably be in a range of from about 1 mm to about 10 mm in view of controlling a polishing rate at a peripheral portion of the semiconductor wafer W, and is set to be 5 mm in the present embodiment.

The pressure chamber 521 above the chucking plate 506 and the pressure chambers 522, 523 are supplied with pressurized fluids such as pressurized air or atmospheric air or evacuated, via the fluid passages 31, 33, 34 to 36 connected to respective pressure chambers. Specifically, the regulators connected to the fluid passages 31, 33, 34 to 36 of the pressure chambers 521 to 523 can respectively regulate pressures of the pressurized fluids supplied to respective pressure chambers. Thus, it is possible to independently control the pressures in the pressure chambers 521 to 523 or independently introduce atmospheric air or vacuum into the pressure chambers 521 to 523. With this arrangement, the pressures of the pressure chambers 521 to 523 can press an entire surface of the semiconductor wafer W except a peripheral portion thereof at a uniform force, and pressure of the pressure chamber 522 can be controlled independently of pressure of the pressure chamber 523. Therefore, it is possible to control a polishing rate at the peripheral portion of the semiconductor wafer W, i.e., a polishing profile of the peripheral portion of the semiconductor wafer W. Additionally, when a pressing force of the retainer ring 3 is controlled, more detailed control can be achieved.

In this case, the pressurized fluid or the atmospheric air supplied to the pressure chambers 522, 523 may independently be controlled in terms of temperature. With this configuration, it is possible to directly control a temperature of a workpiece such as a semiconductor wafer from a backside of a surface to be polished. Particularly, when each of the pressure chambers is independently controlled in terms of temperature, a rate of chemical reaction can be controlled during chemical polishing process of CMP.

The chucking plate 506 has suction portions 540 extended downwardly therefrom between the edge bag 504 and the torque transmitting member 507. In the present embodiment, four suction portions 540 are provided. The suction portions 540 have communication holes 540*a* communicating with a fluid passage 37 comprising tubes and connectors. The suction portions 540 are connected to the compressed air source 120 via a regulator (not shown) connected to fluid passage 37. The compressed air source 120 can develop a negative pressure at lower opening ends of the communication holes 540*a* of the suction portion 540 to attract a semiconductor wafer W to lower ends of the suction portions 540. The suction portions 540 have elastic sheets 540*b*, such as thin rubber sheets, attached to their lower ends, for thereby elastically contacting and holding the semiconductor wafer W on lower surfaces thereof.

Next, operation of the top ring 1 thus constructed will be described in detail below.

In the polishing apparatus constructed above, when a semiconductor wafer W is to be delivered to the polishing apparatus, the top ring 1 as a whole is moved to a position to which the semiconductor wafer W is transferred, and the communication holes 540*a* of the suction portions 540 are connected via the fluid passage 37 to the compressed air source 120. The semiconductor wafer W is attracted under vacuum to lower ends of the suction portions 540 by suction effect of the communication holes 540*a*. With the semiconductor wafer W attracted to the top ring 1, the top ring 1 as a whole is moved to a position above the polishing table 100 having a polishing surface (polishing pad 101) thereon. An outer circumferential edge of the semiconductor wafer W is held by the retainer ring 3 so that the semiconductor wafer W is not removed from the top ring 1.

For polishing the semiconductor wafer W, attraction of semiconductor wafer W by the suction portions 540 is released, and the semiconductor wafer W is held on a lower surface of the top ring 1. Simultaneously, the top ring air cylinder 111 connected to the top ring drive shaft 11 is actuated to press the retainer ring 3 fixed to the lower end of the top ring 1 against the polishing surface on the polishing table 100 under a predetermined pressure. In such a state, pressurized fluids are respectively supplied to the pressure chamber 522 and the pressure chamber 523 under respective pressures, thereby pressing the semiconductor wafer W against the polishing surface on the polishing table 100. The polishing liquid supply nozzle 102 supplies a polishing liquid Q onto the polishing pad 101 in advance, so that the polishing liquid Q is held on the polishing pad 101. Thus, the semiconductor wafer W is polished by the polishing pad 101 with the polishing liquid Q being present between the (lower) surface, to be polished, of the semiconductor wafer W and the polishing pad 101.

Local areas of the semiconductor wafer W that are positioned beneath the pressure chamber 522 and the pressure chamber 523 are pressed against the polishing surface under the pressures of pressurized fluids supplied to the pressure chamber 522 and the pressure chamber 523. Therefore, by controlling the pressurized fluids supplied to the pressure chamber 522 and the pressure chamber 523, polishing pressure applied to the semiconductor wafer W is adjusted so as to press an entire surface of the semiconductor wafer W, except a peripheral portion thereof, against the polishing surface at a uniform force. Simultaneously, a polishing rate at the peripheral portion of the semiconductor wafer W can be controlled to control a polishing profile of the peripheral portion of the semiconductor wafer W. Similarly, the regulator R2 regulates pressure of pressurized fluid supplied to pressure chamber 521 to change a pressing force to press the retainer ring 3 against the polishing pad 101. In this manner, during polishing, the pressing force to press the retainer ring 3 against the polishing pad 101 and the pressing force to press the semiconductor wafer W against the polishing pad 101 are properly adjusted to control a polishing profile of the peripheral portion of the semiconductor wafer W in great detail. The semiconductor wafer W located below the pressure chamber 523 has an area to which a pressing force is applied via the abutment portion 571*b* of the torque transmitting member 507 by a fluid, and an area to which a pressure of the pressurized fluid is directly applied. Pressing forces applied to these areas have the same pressure.

As described above, the pressing force applied by the top ring air cylinder 111 to press the retainer ring 3 against the polishing pad 101 and the pressing forces applied by the pressurized fluids supplied to the pressure chamber 522 and the pressure chamber 523 to press the semiconductor wafer W against the polishing pad 101 are appropriately adjusted to polish the semiconductor wafer W. When polishing of the semiconductor wafer W is finished, the semiconductor wafer W is attracted to the lower ends of the suction portions 540 under vacuum. At this time, supply of the pressurized fluids into the pressure chamber 522 and the pressure chamber 523 is stopped, and the pressure chamber 522 and the pressure chamber 523 are vented to the atmosphere. Accordingly, the lower ends of the suction portions 540 are brought into contact with the semiconductor wafer W. The pressure chamber 521 is vented to an atmosphere or evacuated to develop a negative pressure therein. This is because if the pressure chamber 521 is maintained at a high pressure, then the semiconductor wafer W is strongly pressed against the polishing surface only in areas brought into contact with the suction portions 540.

After attraction of the semiconductor wafer W, the top ring 1 as a whole is moved to a position to which the semiconductor wafer W is to be transferred, and then a fluid (e.g., compressed air or a mixture of nitrogen and pure water) is ejected to the semiconductor wafer W via the communication holes 540*a* of the suction portions 540 to release the semiconductor wafer W from the top ring 1.

The polishing liquid Q used to polish the semiconductor wafer W tends to flow through the small gap G between the outer circumferential surface of the edge bag 504 and the retainer ring 3. If the polishing liquid Q is firmly deposited in the gap G, then the holder ring 505, the chucking plate 506, and the edge bag 504 are prevented from smoothly moving vertically with respect to the top ring body 2 and the retainer ring 3. To avoid such a drawback, a cleaning liquid (pure water) is supplied through the fluid passage 32 to the cleaning liquid passage 551. Accordingly, the pure water is supplied via a plurality of communication holes 553 to a region above the gap G, thus cleaning the gap G to prevent the polishing liquid Q from being firmly deposited in the gap G. The pure water should preferably be supplied after a polished semiconductor wafer W is released and until a next semiconductor wafer to be polished is attracted to the top ring 1.

In the third embodiment described above, the fluid passages 31, 33 to 37 are provided as separate passages. However, these fluid passages may be combined with each other, or the pressure chambers may be communicated with each other in accordance with a magnitude of a pressing force to be applied to the semiconductor wafer W and a position to which the pressing force is applied.

In the third embodiment shown in FIGS. 20 through 22, the polishing surface is constituted by the polishing pad. However, the polishing surface is not limited to this. The polishing surface may be constituted by a fixed abrasive, as described in the first embodiment.

As described above, according to the third embodiment of the present invention, sufficient torque can be transmitted to the substrate by the torque transmitting member. Further, an entire surface of a substrate except a peripheral portion thereof can be pressed against a polishing surface at a uniform force by pressure of a second pressure chamber, and pressure of a first pressure chamber can be controlled independently of the pressure of the second pressure chamber. Therefore, it is possible to control a polishing rate at a peripheral portion of semiconductor wafer W, i.e., a polishing profile of the peripheral portion of the semiconductor wafer W.

INDUSTRIAL APPLICABILITY

The present invention is suitable for use in a substrate holding apparatus for holding a substrate such as a semiconductor wafer in a polishing apparatus for polishing the substrate to a flat finish, and a polishing apparatus having such a substrate holding apparatus.

The invention claimed is:

1. A substrate holding apparatus for holding and pressing a substrate to be polished against a polishing surface, comprising:

a top ring body having a receiving space therein;

a vertically movable member in said top ring body, said vertically movable member being vertically movable within said receiving space; and an abutment member, having an elastic membrane, attached to a lower surface of said vertically movable member, said elastic membrane including (i) an abutment portion, having a flange projecting outwardly, to be brought into direct or indirect contact with a substrate, and (ii) a connecting portion extending upwardly from a base portion of said flange and being connected to said vertically movable member, with said connecting portion being made of a material having a flexibility greater than a flexibility of said abutment portion.

2. The substrate holding apparatus according to claim 1, wherein said connecting portion includes a radially inward connecting portion member and a radially outward connecting portion member, with a thickness of said radially inward connecting portion member being different than a thickness of said radially outward connecting portion member.

3. The substrate holding apparatus according to claim 2, wherein said thickness of said radially inward connecting portion member is less than said thickness of said radially outward connecting portion member.

4. The substrate holding apparatus according to claim 1, wherein said flange projects radially outwardly, and said abutment portion also has a flange projecting radially inwardly, with a length of said flange projecting radially outwardly being different than a length of said flange projecting radially inwardly.

5. The substrate holding apparatus according to claim 4, wherein said length of said flange projecting radially outwardly is greater than said length of said flange projecting radially inwardly.

6. A polishing apparatus comprising:

a substrate holding apparatus according to claim 1; and a polishing table having a polishing surface.

7. A substrate holding apparatus for holding and pressing a substrate to be polished against a polishing surface, comprising:

a top ring body having a receiving space therein;

a vertically movable member in said top ring body, said vertically movable member being vertically movable within said receiving space; and an abutment member, having an elastic membrane, attached to a lower surface of said vertically movable member, said elastic membrane including (i) an abutment portion, having a flange projecting outwardly, to be brought into direct or indirect contact with a substrate, and (ii) a connecting portion extending upwardly from a base portion of said flange and being connected to said vertically movable member, with said connecting portion including a thin portion having a thickness less than a thickness of said abutment portion.

8. The substrate holding apparatus according to claim 7, wherein said thin portion is constricted inwardly in a cross-section.

9. The substrate holding apparatus according to claim 7, wherein said connecting portion includes a radially inward connecting portion member and a radially outward connecting portion member, with a thickness of said radially inward connecting portion member being different than a thickness of said radially outward connecting portion member.

10. The substrate holding apparatus according to claim 9, wherein said thickness of said radially inward connecting portion member is less than said thickness of said radially outward connecting portion member.

11. The substrate holding apparatus according to claim 7, wherein said flange projects radially outwardly, and said abutment portion also has a flange projecting radially inwardly, with a length of said flange projecting radially outwardly being different than a length of said flange projecting radially inwardly.

12. The substrate holding apparatus according to claim 11, wherein said length of said flange projecting radially outwardly is greater than said length of said flange projecting radially inwardly.

13. A polishing apparatus comprising:

a substrate holding apparatus according to claim 7; and a polishing table having a polishing surface.

14. A substrate holding apparatus for holding and pressing a substrate to be polished against a polishing surface, comprising:

a top ring body having a receiving space therein;

a vertically movable member in said top ring body, said vertically movable member being vertically movable within said receiving space; and an abutment member, having an elastic membrane, attached to a lower surface of said vertically movable member, said elastic membrane including (i) an abutment portion, having a flange projecting outwardly, to be brought into direct or indirect contact with a substrate, and (ii) a connecting portion extending upwardly from a base portion of said flange and being connected to said vertically movable member, with an adhesiveness of a lower surface of said base portion of said flange being weakened.

15. The substrate holding apparatus according to claim 14, wherein said adhesiveness of said lower surface of said base portion of said flange is weakened via an intermediate member, having a low adhesiveness relative to a substrate to be polished, being disposed on said lower surface of said base portion of said flange.

16. The substrate holding apparatus according to claim 14, wherein said connecting portion includes a radially inward connecting portion member and a radially outward connecting portion member, with a thickness of said radially inward connecting portion member being different than a thickness of said radially outward connecting portion member.

17. The substrate holding apparatus according to claim 16, wherein said thickness of said radially inward connecting portion member is less than said thickness of said radially outward connecting portion member.

18. The substrate holding apparatus according to claim 14, wherein said flange projects radially outwardly, and said abutment portion also has a flange projecting radially inwardly, with a length of said flange projecting radially outwardly being different than a length of said flange projecting radially inwardly.

19. The substrate holding apparatus according to claim 18, wherein said length of said flange projecting radially outwardly is greater than said length of said flange projecting radially inwardly.

20. A polishing apparatus comprising:

a substrate holding apparatus according to claim 14; and a polishing table having a polishing surface.

21. A substrate holding apparatus for holding and pressing a substrate to be polished against a polishing surface, comprising:

a top ring body having a receiving space therein;

a vertically movable member in said top ring body, said vertically movable member being vertically movable within said receiving space; and an abutment member, having an elastic membrane, attached to a lower surface of said vertically movable member, said elastic membrane including (i) an abutment portion, having a flange projecting outwardly, to be brought into direct or indirect contact with a substrate, and (ii) a connecting portion extending upwardly from a base portion of said flange and being connected to said vertically movable member; and a hard member, made of a material harder than material of said elastic membrane, embedded in said base portion of said flange.

22. The substrate holding apparatus according to claim 21, wherein said hard member has an annular shape.

23. The substrate holding apparatus according to claim 21, wherein said connecting portion includes a radially inward connecting portion member and a radially outward connecting portion member, with a thickness of said radially inward connecting portion member being different than a thickness of said radially outward connecting portion member.

24. The substrate holding apparatus according to claim 23, wherein said thickness of said radially inward connecting portion member is less than said thickness of said radially outward connecting portion member.

25. The substrate holding apparatus according to claim 21, wherein said flange projects radially outwardly, and said abutment portion also has a flange projecting radially inwardly, with a length of said flange projecting radially outwardly being different than a length of said flange projecting radially inwardly.

26. The substrate holding apparatus according to claim 25, wherein said length of said flange projecting radially outwardly is greater than said length of said flange projecting radially inwardly.

27. A polishing apparatus comprising:

a substrate holding apparatus according to claim 21; and a polishing table having a polishing surface.

28. A substrate holding apparatus for holding and pressing a substrate to be polished against a polishing surface, comprising:

a top ring body having a receiving space therein;

a vertically movable member in said top ring body, said vertically movable member being vertically movable within said receiving space;

an abutment member, having an elastic membrane, attached to a lower surface of said vertically movable member, said elastic membrane including (i) an abutment portion, having a flange projecting outwardly, to be brought into direct or indirect contact with a substrate, (ii) an extending portion extending outwardly from a base portion of said flange to a position inward of a tip of said flange so as to form a groove between said extending portion and said flange, and (iii) a connecting portion extending upwardly from an outward end of said extending portion and being connected to said vertically movable member.

29. The substrate holding apparatus according to claim 28, wherein said connecting portion includes a radially inward connecting portion member and a radially outward connecting portion member, with a thickness of said radially inward connecting portion member being different than a thickness of said radially outward connecting portion member.

30. The substrate holding apparatus according to claim 29, wherein said thickness of said radially inward connecting portion member is less than said thickness of said radially outward connecting portion member.

31. The substrate holding apparatus according to claim 28, wherein said flange projects radially outwardly, and said abutment portion also has a flange projecting radially inwardly, with a length of said flange projecting radially outwardly being different than a length of said flange projecting radially inwardly.

32. The substrate holding apparatus according to claim 31, wherein said length of said flange projecting radially outwardly is greater than said length of said flange projecting radially inwardly.

33. A polishing apparatus comprising:

a substrate holding apparatus according to claim 28; and a polishing table having a polishing surface.

34. A substrate holding apparatus for holding and pressing a substrate to be polished against a polishing surface, comprising:

a top ring; and an abutment member having an elastic membrane attached to a lower surface of said top ring, said elastic membrane including (i) an abutment portion, having a flange projecting outwardly, to be brought into direct or indirect contact with a substrate, and (ii) a connecting portion extending upwardly from a base portion of said flange and being connected to said top ring, wherein said top ring has a support portion for supporting said flange.

35. The substrate holding apparatus according to claim 34, wherein said support portion has a radial length greater than a radial length of said flange.

36. The substrate holding apparatus according to claim 34, further comprising:

a fluid introduction groove, in said support portion, for introducing a fluid into an upper surface of said flange.

37. A polishing apparatus comprising:

a substrate holding apparatus according to claim 34; and a polishing table having a polishing surface.

38. A substrate holding apparatus for holding and pressing a substrate to be polished against a polishing surface, comprising:

a top ring body having a receiving space therein;

a vertically movable member in said top ring body, said vertically movable member being vertically movable within said receiving space; and a seal ring to be brought into contact with an upper surface of a peripheral portion of a substrate, wherein said vertically movable member has a support portion for supporting said seal ring, said support portion having a radial length in a range of from 1 mm to 7 mm.

39. The substrate holding apparatus according to claim 38, further comprising:

a fluid introduction groove, in said support portion, for introducing a fluid into an upper surface of said seal ring.

40. A polishing apparatus comprising:

a substrate holding apparatus according to claim 38; and a polishing table having a polishing surface.

41. A substrate holding apparatus for holding and pressing a substrate to be polished against a polishing surface, comprising:

a top ring body having a receiving space therein;

a vertically movable member in said top ring body, said vertically movable member being vertically movable within said receiving space; and an abutment member, having an elastic membrane, attached to a lower surface of said vertically movable member, said elastic membrane including (i) an abutment portion, having a flange projecting outwardly, to be brought into direct or indirect contact with a substrate, and (ii) a connecting portion extending upwardly from a base portion of said flange and being connected to said vertically movable member.

42. A polishing apparatus comprising:

a substrate holding apparatus according to claim 41; and a polishing table having a polishing surface.

* * * * *

UNITED STATES PATENT AND TRADEMARK OFFICE

CERTIFICATE OF CORRECTION

PATENT NO. : 7,033,260 B2
APPLICATION NO. : 10/497151
DATED : April 25, 2006
INVENTOR(S) : Tetsuji Togawa et al.

It is certified that error appears in the above-identified patent and that said Letters Patent is hereby corrected as shown below:

ON THE TITLE PAGE:

In Item (30) Foreign Application Priority Data:

Please change "Dec. 12, 2001 (JP) … 2002-379337" to --Dec. 12, 2001 (JP) … 2001-379337--.

Signed and Sealed this

Seventeenth Day of October, 2006

JON W. DUDAS
*Director of the United States Patent and Trademark Office*